US009936773B2

(12) United States Patent
Okuda et al.

(10) Patent No.: US 9,936,773 B2
(45) Date of Patent: Apr. 10, 2018

(54) MOLDED HOOK AND LOOP FASTENER AND METHOD OF MANUFACTURING CUSHION BODY

(71) Applicant: YKK Corporation, Tokyo (JP)

(72) Inventors: Kenji Okuda, Toyama (JP); Mineto Terada, Toyama (JP); Shinichi Imai, Toyama (JP)

(73) Assignee: YKK Corporation (JP)

( * ) Notice: Subject to any disclaimer, the term of this patent is extended or adjusted under 35 U.S.C. 154(b) by 287 days.

(21) Appl. No.: 14/759,460

(22) PCT Filed: Jan. 7, 2013

(86) PCT No.: PCT/JP2013/050024
§ 371 (c)(1),
(2) Date: Jul. 7, 2015

(87) PCT Pub. No.: WO2014/106896
PCT Pub. Date: Jul. 10, 2014

(65) Prior Publication Data

US 2015/0335106 A1 Nov. 26, 2015

(51) Int. Cl.
*A44B 18/00* (2006.01)

(52) U.S. Cl.
CPC ..... *A44B 18/0069* (2013.01); *A44B 18/0049* (2013.01); *A44B 18/0061* (2013.01); *A44B 18/0076* (2013.01); *Y10T 24/2717* (2015.01)

(58) Field of Classification Search
CPC ..... A44B 18/0061; A44B 18/0076; A44B 18/0069; A44B 18/0049; A44B 18/008; B60N 2/5825
See application file for complete search history.

(56) References Cited

U.S. PATENT DOCUMENTS 4,563,380 A * 1/1986 Black ..... A44B 18/0076 24/306
4,710,414 A * 12/1987 Northrup ..... B29C 44/1271 24/306
(Continued)

FOREIGN PATENT DOCUMENTS

CN 1231585 A 10/1999
CN 1537486 A 10/2004
(Continued)

OTHER PUBLICATIONS

Office Action and Search Report, Chinese Patent Application No. 201380069762.0, dated Feb. 4, 2017.
(Continued)

*Primary Examiner* — Jason W San
(74) *Attorney, Agent, or Firm* — Kilpatrick Townsend & Stockton LLP

(57) ABSTRACT

There is provided a molded hook and loop fastener having at least one hook and loop fastener member which includes a flat plate-shaped base material and a plurality of engaging elements erected on a first surface of the base material in a center region in a width direction thereof, and configured to be integrated with a cushion body upon foaming of the cushion body. A flexible sheet-shaped resin material infiltration-blocking member is fixed to right and left side edge portions of the first surface of the base material and arranged along a longitudinal direction. Right and left support members are erected on the inside of fixation portions of the resin material infiltration-blocking member with respect to the base material, to support the resin material infiltration-blocking member. An upper end of the resin material infiltration-blocking member is configured to protrude above an upper end location of the support members.

14 Claims, 17 Drawing Sheets

(56) References Cited

U.S. PATENT DOCUMENTS 4,784,890 A * 11/1988 Black ..... A44B 18/0076 24/306
4,802,939 A * 2/1989 Billarant ..... A44B 18/0076 156/155
4,842,916 A * 6/1989 Ogawa ..... A44B 18/0073 24/444
4,931,344 A * 6/1990 Ogawa ..... A44B 18/0073 24/444
5,058,245 A * 10/1991 Saito ..... A44B 18/0076 24/306
5,766,723 A * 6/1998 Oborny ..... A44B 18/0076 24/442
5,786,061 A * 7/1998 Banfield ..... A44B 18/0076 24/442
5,900,303 A * 5/1999 Billarant ..... A44B 18/0076 24/442
5,942,177 A 8/1999 Banfield
6,148,487 A * 11/2000 Billarant ..... A44B 18/0076 24/306
6,463,635 B2 * 10/2002 Murasaki ..... A44B 18/0076 24/306
6,656,563 B1 * 12/2003 Leach ..... A44B 18/0049 24/442
6,720,059 B2 * 4/2004 Fujisawa ..... A44B 18/0046 24/442
7,152,283 B2 * 12/2006 Murayama ..... A44B 18/0003 24/306
7,425,360 B2 * 9/2008 Line ..... A44B 18/0076 24/306
7,431,976 B2 * 10/2008 Hermann ..... A44B 18/0076 24/442
7,608,070 B2 * 10/2009 Chen ..... A61F 13/627 604/385.03
7,648,751 B2 * 1/2010 Janzen ..... A44B 18/0076 24/442
7,998,548 B2 * 8/2011 Murasaki ..... A44B 18/0076 24/442
8,043,541 B2 * 10/2011 Nozawa ..... A44B 18/0076 264/214
8,142,705 B2 * 3/2012 Breest ..... B29C 33/306 264/261
8,322,002 B2 * 12/2012 Cheng ..... B60N 2/5833 24/298
8,512,845 B2 * 8/2013 Terada ..... A44B 18/0049 428/100
8,756,770 B2 * 6/2014 Cina ..... A44B 18/0049 24/452
9,034,452 B2 * 5/2015 Cina ..... B32B 3/30 428/100
9,138,032 B1 * 9/2015 Cina ..... A44B 18/0076
9,271,546 B2 * 3/2016 Terada ..... A44B 18/0065
9,271,547 B2 * 3/2016 Terada ..... A44B 18/0049
9,357,815 B2 * 6/2016 Minato ..... A44B 18/0049
9,399,333 B2 * 7/2016 Medina ..... B32B 3/06
9,433,262 B2 * 9/2016 Okuda
9,504,295 B2 * 11/2016 Kheil ..... B65D 33/2541
9,504,296 B2 * 11/2016 Cina ..... A44B 18/0076
9,781,979 B2 * 10/2017 Minato ..... A44B 18/0049
9,826,801 B2 * 11/2017 Mascarenhas ..... A44B 18/008
2002/0023322 A1 * 2/2002 Murasaki ..... A44B 18/0076 24/452
2002/0164449 A1 * 11/2002 Fujisawa ..... A44B 18/0049 428/99
2002/0164451 A1 * 11/2002 Fujisawa ..... A44B 18/0046 428/100
2004/0172792 A1 9/2004 Kurtz, Jr.
2005/0160534 A1 * 7/2005 Akeno ..... A44B 18/0076 5/652
2008/0088169 A1 * 4/2008 Janzen ..... A44B 18/0076 297/463.2
2010/0162535 A1 * 7/2010 Cheng ..... B29C 44/1261 24/306
2010/0181695 A1 * 7/2010 Murasaki ..... A44B 18/0076 264/176.1
2011/0167598 A1 * 7/2011 Cheng ..... B60N 2/5833 24/306
2011/0197404 A1 * 8/2011 Terada ..... A44B 18/0049 24/442
2013/0149490 A1 * 6/2013 Cina ..... B32B 3/30 428/100
2013/0340214 A1 * 12/2013 Terada ..... A44B 18/0049 24/444
2014/0130311 A1 * 5/2014 Okuda ..... A44B 18/0049 24/449
2014/0138993 A1 * 5/2014 Cheng ..... A47C 31/02 297/217.1
2014/0298628 A1 * 10/2014 Minato ..... A44B 18/0049 24/449
2015/0164186 A1 * 6/2015 Cina ..... A44B 18/0076 24/449
2015/0335106 A1 * 11/2015 Okuda ..... A44B 18/0076 24/443
2016/0031349 A1 * 2/2016 Lee ..... A44B 18/0069 24/449
2016/0316860 A1 * 11/2016 Cina ..... A44B 18/0003
2016/0331085 A1 * 11/2016 Mizumoto ..... A44B 18/0049
2016/0366991 A1 * 12/2016 Mascarenhas ..... A44B 18/0076
2017/0013918 A1 * 1/2017 Ren ..... A44B 18/008
2017/0119107 A1 * 5/2017 Okuda ..... A44B 18/0076
2017/0150788 A1 * 6/2017 Imai ..... A44B 18/0049
2017/0224060 A1 * 8/2017 Smith ..... A44B 18/008
2017/0240081 A1 * 8/2017 Cheng ..... B60N 2/5825
2017/0295890 A1 * 10/2017 Imai ..... A44B 18/0076

FOREIGN PATENT DOCUMENTS

| | | | |
|---|---|---|---|
| JP | S64-043705 | A | 3/1989 |
| JP | H3-146004 | A | 6/1991 |
| JP | H4-109904 | A | 4/1992 |
| JP | 2000-516485 | A | 12/2000 |
| JP | 2011-143231 | A | 7/2011 |
| TW | 201023783 | A | 7/2010 |
| WO | 98/05232 | A1 | 2/1998 |
| WO | 01/89338 | A2 | 11/2001 |
| WO | 2009/058179 | A1 | 5/2009 |

OTHER PUBLICATIONS

Search Report, Chinese Patent Application No. 201380069762.0, dated Feb. 4, 2017.

International Search Report, PCT Application No. PCT/JP2013/050024, dated Apr. 9, 2013.

* cited by examiner

MOLDED HOOK AND LOOP FASTENER AND METHOD OF MANUFACTURING CUSHION BODY

This application is a national stage application of PCT/JP2013/050024, which is incorporated herein by reference.

TECHNICAL FIELD

The present invention relates to a molded hook and loop fastener integrated with a surface of a foam body upon foaming of the foam body, and a method of manufacturing a cushion body with the molded hook and loop fastener integrated, and in particular, to a molded hook and loop fastener, in which upon foaming of a cushion body, infiltration of a foaming resin material into an engaging element region of a hook and loop fastener member thereof can be effectively blocked, and a method of manufacturing a cushion body with the molded hook and loop fastener integrated therewith.

BACKGROUND ART

Seats of vehicles or trains, various sofas, office chairs and the like are often configured so that a surface of a cushion body (foam body) molded in a predetermined shape using a foaming resin material is covered with a cover material made of fiber fabric, natural or synthetic leather or the like. The cushion bodies used in such various seats or the like may have a curved surface formed in an unevenness shape, which meets ergonomic requirements, to keep a sitting posture, in which a user is not tired even if sitting thereon for a long time.

Also, when the cover material is covered on the surface of the cushion body, a technique is often employed in which the cushion body is molded in a desired shape and then the cover material is covered and fixed on the surface of the obtained cushion body. In this case, particularly, a molded hook and loop fastener is commonly used as a means for fixing a surface of the cushion body and a back surface of the cover material to each other.

The molded hook and loop fastener is configured so that a plurality of engaging elements (e.g., male engaging elements) are arranged on one surface (first surface) of a base material made of thermoplastic resin, and the molded hook and loop fastener is integrally molded to expose the engaging elements on the surface of the cushion body upon molding of the cushion body. Also, on the back surface of the cover material for covering the cushion body, a plurality of engaging elements (female engaging elements) capable of engaging with the engaging elements of the molded hook and loop fastener are provided.

Then, after the cover material is covered on the cushion body with the molded hook and loop fastener integrated, the female engaging elements arranged on the back surface of the cover material are pressed toward the male engaging elements of the molded hook and loop fastener exposed on the surface of the cushion body, thereby engaging the cover material to molded hook and loop fastener. Thus, the cover material can be easily fixed to the surface of the cushion body along the unevenness shape of the surface, thereby preventing the cover material from being floated from the cushion body.

For the molded hook and loop fastener used in fixing the cover material and the cushion body to each other, in order to stably ensure a required fixation strength, it is necessary to prevent a foaming resin material for the cushion body from infiltrating into a region of the molded hook and loop fastener (engaging element region), in which engaging elements thereof is formed, upon foaming of the cushion body and thus to expose the engaging element region of the molded hook and loop fastener on the surface of the cushion body.

Meanwhile, for example, in Japanese Utility Model Application Publication No. S64-43705 (Patent Document 1), a hook and loop fastener is disclosed which can prevent infiltration of a resin material into an engaging element region and is configured to be integrated with a cushion body.

For example, as shown in FIG. 22, a hook and loop fastener 80 described in Patent Document 1 includes a hook and loop fastener member 81 having a plurality of hook-shaped engaging elements 83 erected on a surface of a flat plate-shaped base material 82, resin infiltration-preventing members 84 arranged along right and left side edge portions of the base material 82 and made of a non-woven fabric having a generally L-shaped cross-section, and a fixation member 85 made of a non-woven fabric arranged on a back surface of the base material 82.

Also, in Patent Document 1, the resin infiltration-preventing members 84 and fixation member 85 are fixed to the hook and loop fastener member 81 by welding, such as high frequency welding or thermal welding, or bonding with an adhesive. In addition, the generally L-shaped cross-sectioned resin infiltration-preventing members 84 are arranged to be spaced outward in a width direction from locations of the hook-shaped engaging elements 83 erected on the base material 82.

When a cushion body with which the hook and loop fastener 80 of Patent Document 1 is integrated is foamed, as shown in FIG. 23, the hook and loop fastener 80 is mounted on an inner surface (cavity surface) of a cushion body molding mold 86 and then a foaming resin material 87 is injected into an inner space (cavity space) of the mold 86.

In this case, in the inner surface of the mold 86, a concave groove portion (trench portion) 88 is provided to allow a part of the hook and loop fastener 80 to be inserted therein and thus to position and hold the hook and loop fastener 80, and the concave groove portion 88 is formed to have a groove shape, groove dimension and groove depth corresponding to a shape of the hook and loop fastener 80. The plurality of engaging elements 83 and one leg portion of each of the generally L-shaped resin infiltration-preventing members 84 are inserted in the concave groove portion 88 of the mold 86. At this time, the other leg portion of each of the resin infiltration-preventing members 84 is arranged to be sandwiched between the base material 82 of the hook and loop fastener 80 and the inner surface of the mold 86.

In such a state where the hook and loop fastener 80 is set in the concave groove portion 88 of the mold 86, the foaming resin material 87 is injected into the mold 86 to perform foaming Thus, the resin infiltration-preventing member 84 made of a non-woven fabric absorbs the foaming resin material 87 and also prevents the foaming resin material 87 from infiltrating into the concave groove portion 88, thereby allowing the cushion body, with which the hook and loop fastener 80 is integrated, to be manufactured.

Thus, in the cushion body with the hook and loop fastener 80 integrated manufactured as described above, the engaging elements 83 of the hook and loop fastener 80 is prevented from being potted with the foam body and thus the engaging elements 83 of the hook and loop fastener 80 can be exposed on the outer surface of the cushion body. Accordingly, in the cushion body with the hook and loop fastener 80 integrated, reduction of an engaging force by the engaging elements 83 can be prevented.

Also, in International Patent Application Publication No. WO 2009/058179 (Patent Document 2), a molded hook and loop fastener is disclosed in which an anchor layer made of a non-woven fabric is fixed to a back surface of a base material having a plurality of engaging elements erected on a surface thereof.

Also, the molded hook and loop fastener of Patent Document 2 is configured so that the non-woven fabric, which is the anchor layer, extends outward in a width direction from right and left end edges of the base material of the molded hook and loop fastener. In addition, a magnetically attractable coating layer is formed on a back surface of a part of the non-woven fabric, which is fixed to the base material, and front surfaces of parts thereof, which extend outward from the right and left end edges of the base material.

When a cushion body with the molded hook and loop fastener of Patent Document 2 integrated is foamed, a molding mold having magnets arranged on a cavity surface thereof is used. The molded hook and loop fastener is mounted on a part of the mold, on which the magnets are arranged, so that the plurality of engaging elements face to the cavity surface, and as a result, the coating layer formed on the non-woven fabric of the molded hook and loop fastener is attracted to the magnets. Thus, the molded hook and loop fastener is attracted and fixed to the cavity surface of the mold by a magnetic force, and also the non-woven fabric extending from the right and left end edges of the base material is attracted to the magnets to be contacted with the cavity surface of the mold.

In this state, when injection molding of a foaming resin material is performed, infiltration of the foaming resin material into a region of the molded hook and loop fastener, in which the engaging elements are formed, is prevented because the non-woven fabric extending from the right and left end edges of the base material is contacted with the cavity surface so that the plurality of engaging elements are confined inside of the non-woven fabric. Thus, the cushion body with the hook and loop fastener integrated can be manufactured.

PRIOR ART DOCUMENT

Patent Document

Patent Document 1: Japanese Utility Model Application Publication No. S64-43705

Patent Document 2: International Patent Application Publication No. WO 2009/058179

SUMMARY OF INVENTION

Problems to Be Solved by Invention

When the hook and loop fastener 80 described in Patent Document 1 as described above is integrated with a cushion body obtained by foaming, it is necessary to previously provide the concave groove portion (trench portion) 88 as described above in the inner surface of the mold 86 to correspond to a region of the cushion, which is to be provided with the hook and loop fastener member 80, and then to position and hold the hook and loop fastener 80 of Patent Document 1 relative to the mold 86.

The cushion body with the hook and loop fastener integrated is often changed in shape and size depending on applications thereof, and also a position at which the hook and loop fastener is integrated with the cushion body is often changed. In addition, depending on manufactures of manufacturing cushion bodies or the like, types of foaming resin materials constructing the cushion bodies are different from each other.

Accordingly when the hook and loop fastener 80 of Patent Document 1 is used, as described above, the concave groove portion 88 needs to be provided at a predetermined location in the inner surface of the mold 86 depending on applications of the cushion body, and thus, there is a problem in that manufacturing of the mold 86 to be used for molding is complicated. Also, when the shape of the cushion body is changed and also when an attaching position of the hook and loop fastener to be integrated therewith is changed even if the entire shape of the cushion body is not changed, new molds have to be manufactured on all such cases. Therefore, costs or workloads required to manufacture the mold 86 are increased.

In addition, in the case of the hook and loop fastener 80 described in Patent Document 1, for example, it may be conceived that no concave groove portion 88 as described above is provided in the inner surface of the mold 86 and thus the hook and loop fastener 80 is mounted to a flat surface on the inner surface of the mold 86 so that the plurality of engaging elements 80 and the right and left resin infiltration-preventing members 84 made of a non-woven fabric face the flat surface, and then foaming of the cushion is performed. When foaming is performed in this way, it may be believed that because the plurality of engaging elements 83 are confined inside of the right and left resin infiltration-preventing members 84, infiltration of the foaming resin material 87 into the region of the molded hook and loop fastener 80 in which the engaging elements 83 are formed may be prevented.

However, in the hook and loop fastener 80 of Patent Document 1, the L-shaped cross-sectioned resin infiltration-preventing members 84 is made of a non-woven fabric and also one leg portion in the L-shape of the non-woven fabric is kept independently stood up from the base material 82. In addition, by means of only the resin material infiltration-preventing members 84, which are constructed of the non-woven fabric independently stood up from the base material 82 in such a way, a strength sufficient for a blocking wall (barrier) for preventing infiltration of the foaming resin material cannot be obtained and thus one leg portion of each of the resin infiltration-preventing members 84 is likely to be collapsed or bent.

Therefore, the resin infiltration-preventing member 84 of Patent Document 1 cannot withstand a flowing pressure or foaming pressure of the foaming resin material 87 injected into the mold 86 upon foaming, and as a result, allows the foaming resin material 87 to infiltrate into a region, on which the engaging elements are erected, through the collapsed or bent resin infiltration-preventing member 84. Thus, there is a possibility of reducing an engaging force of the molded hook and loop fastener 80.

On the other hand, when the molded hook and loop fastener is integrally molded with a cushion body, the coating layer of the non-woven fabric extending from the right and left end edges of the base material is attracted to the magnets as described above and thus the extended piece of the non-woven fabric is contacted with the cavity surface of the mold. Accordingly, the plurality of engaging elements are kept confined inside of the extended piece of the non-woven fabric. Thus, it is possible to prevent the foaming resin material from infiltrating into a region of the molded hook and loop fastener, in which the engaging elements are formed.

However, in the molded hook and loop fastener of Patent Document 2, the magnetic force between the coating layer of the non-woven fabric and the magnets is used, but the extended piece of the non-woven fabric, which is intended to prevent the foaming resin material from infiltrating into the engaging element-formed region, is likely to be moved. Accordingly, if a flowing pressure or foaming pressure of the foaming resin material injected into the mold is increased, the extended piece which is in contact with the cavity surface of the mold is likely to be floated from the cavity surface due to the flowing pressure or foaming pressure of the foaming resin material exerted thereon. Thus, there is a possibility of allowing infiltration of the foaming resin material.

Also, for example, when the used foaming resin material has a low viscosity, there is a possibility that infiltration of the foaming resin material cannot be sufficiently prevented by means of only contacting the extended piece of the non-woven fabric, which extends from the base material, with the cavity surface of the mold as in the molded hook and loop fastener of Patent Document 2.

In addition, for example, upon foaming of a cushion body, a foaming resin material may be sprayed through a spraying nozzle while the spray nozzle is moved relative to the mold. In this case, the foaming resin material may be jetted in a direction oblique to a molded hook and loop fastener. When he foaming resin material is jetted in a direction oblique to the molded hook and loop fastener of Patent Document 2 set on the cavity surface of the mold, the extended piece of the non-woven fabric, which extends from the base material and is in contact with the cavity surface, is likely to be rolled, and thus infiltration of the foaming resin material may be allowed through the rolled part of the extended piece.

The present invention has been made keeping in mind the above problems, and an object thereof is to provide a molded hook and loop fastener, which can reduce costs or workloads required to manufacture a mold for molding a cushion body and can effectively prevent a foaming resin material from infiltrating into an engaging element-formed region upon foaming of the cushion body so that an engaging force by engaging elements can be stably ensured, and also to provide a method of manufacturing a cushion body with the molded hook and loop fastener integrated.

Means for Solving Problems

In order to achieve the object, a molded hook and loop fastener provided according to the present invention includes, as basic conjurations, at least one hook and loop fastener member which comprises a flat plate-shaped base material and a plurality of engaging elements erected on a first surface of the base material in a center region in a width direction thereof, and configured to be integrated with a cushion body upon foaming of the cushion body, the molded hook and loop fastener including a flexible sheet-shaped resin material infiltration-blocking member fixed to right and left side edge portions, in the width direction, of the first surface of the base material and arranged along a longitudinal direction of the base material, and right and left support members erected along the longitudinal direction of the base material at locations which are located on the inside of fixation portions of the resin material infiltration-blocking member with respect to the base material in the width direction, and configured to support the resin material infiltration-blocking member, wherein an upper end of the resin material infiltration-blocking member is configured to protrude above an upper end location of the support members.

Preferably, the molded hook and loop fastener according to the present invention is constituted of one hook and loop fastener member, and the resin material infiltration-blocking member includes right and left first frame portions continuously arranged over the entire length of the base material in the longitudinal direction and second frame portions arranged along the width direction of the hook and loop fastener member on both ends of the hook and loop fastener member in the longitudinal direction and configured to connect the right and left frame portions with each other.

In this case, preferably, the first frame portions and the second frame portions are integrally formed with each other, and the resin material infiltration-blocking member is constructed of a single member. Preferably, the resin material infiltration-blocking member includes a rectangular opening portion surrounded by the first frame portions and the second frame portions, and a dimension of the opening portion in the width direction is set to be smaller than a dimension between outer surfaces of the right and left support members and also a dimension of the opening portion in the longitudinal direction is set to be smaller than a dimension of the hook and loop fastener member in the longitudinal direction.

Further, according to the molded hook and loop fastener of the present invention, the sheet-shaped resin material infiltration-blocking member may have a tubular shape obtained by connecting side edge portions of the resin material infiltration-blocking member to each other and may be fixed to the right and left side edge portions of the base material.

In addition, the molded hook and loop fastener according to the present invention may include a plurality of hook and loop fastener members and a flexible connection member for connecting the plurality of hook and loop fastener members along the longitudinal direction, and the resin material infiltration-blocking member may include right and left first frame portions continuously arranged in the longitudinal direction over the plurality of hook and loop fastener members and second frame portions arranged in the width direction of the hook and loop fastener members to bridge between the adjacent hook and loop fastener members and configured to connect the right and left first frame portions with each other.

In this case, preferably, the first frame portions and the second frame portions are integrally formed with each other, and the resin material infiltration-blocking member is constructed of a single member. Also, preferably, the sheet-shaped resin material infiltration-blocking member has a constant width dimension over the entire length thereof in the longitudinal direction and is configured to cover the plurality of hook and loop fastener members over the entire width of the hook and loop fastener members in the width direction. In addition, the connection member is preferably configured to connect center portions, in the width direction, of the plurality of hook and loop fastener members to each other on a lower surface of the resin material infiltration-blocking member.

Further, according to the molded hook and loop fastener of the present invention, the resin material infiltration-blocking member is preferably configured to extend outward in the width direction beyond right and left end edges of the base material. In addition, the resin material infiltration-blocking member is preferably constructed of a non-woven fabric.

Furthermore, preferably, the right and left support members are constituted of wall members integrally formed with the base material and intermittently or continuously erected thereon along a front and rear direction so that an engaging element region constituted of a plurality of engaging elements is interposed therebetween.

Next, a method of manufacturing a cushion body provided according to the present invention is configured so that the molded hook and loop fastener having the configurations as described above is closely contacted with a fastener mount surface of a mold so that the first surface of the base material faces the fastener mount surface, and then foaming is performed so that the molded hook and loop fastener is integrated with the cushion body.

Also, in the method of manufacturing the cushion body according to the present invention, the fastener mount surface of the mold is formed as a single surface and thus the method includes closely contacting the molded hook and loop fastener with the single surface.

Advantageous Effects of Invention

The molded hook and loop fastener according to the present invention includes at least one hook and loop fastener member having a plurality of engaging elements erected on a flat plate-shaped base material in a center region, a flexible sheet-shaped resin material infiltration-blocking member fixed to right and left side edge portions of the base material and arranged along a longitudinal direction of the base material, and right and left support members erected along the longitudinal direction of the base material at locations, which are located on the inside of fixation portions of the resin material infiltration-blocking member with respect to the base material in the width direction. Also, the resin material infiltration-blocking member is configured so that an upper end thereof protrudes above an upper end location of the support members.

Meanwhile, in the present invention, the first surface of the base material refers to the surface thereof, on which engaging elements are erected, and also is a surface to be exposed to the exterior when the molded hook and loop fastener is integrated with the cushion body. Also, a second surface of the base material refers to a surface opposite to the surface on which engaging elements are erected and is a surface facing the cushion body when the molded hook and loop fastener is integrated with the cushion body.

According to the molded hook and loop fastener according to the present invention, the resin material infiltration-blocking member, which is supported by the support members and has the upper end thereof protruded above the support members when the molded hook and loop fastener is set on a fastener mount surface, which is a part of a cavity surface of a foaming mold for molding a cushion body, can be stably closely contacted with the cavity surface to prevent a gap from being occurred between the resin material infiltration-blocking member and the cavity surface (fastener mount surface) of the mold, thereby significantly enhancing a sealing ability of the resin material infiltration-blocking member. In addition, because the resin material infiltration-blocking member is supported by the support members, the state where the resin material infiltration-blocking is closely contacted with the cavity surface (sealing ability of the resin material infiltration-blocking member) can be stably kept.

Thus, for example, even if a flowing pressure or foaming pressure of a foaming resin material injected into the mold is increased, the used foaming resin material has a low viscosity or the foaming resin material is jetted in a direction oblique to the molded hook and loop fastener, it is possible to effectively prevent the foaming resin material from infiltrating into the engaging element region, in which a plurality of engaging elements are erected, over the resin material infiltration-blocking member of the molded hook and loop fastener upon foaming of the cushion body. Accordingly, the molded hook and loop fastener integrated with the cushion body can stably ensure an engaging force (fastening force) inherent in a plurality of engaging elements formed on the molded hook and loop fastener.

Also, the molded hook and loop fastener of the present invention can effectively prevent the foaming resin material from infiltrating into the engaging element region, in particular, when the molded hook and loop fastener is set on the cavity surface (e.g., flat cavity surface) formed as a single surface of the mold. Accordingly, it is not necessary to provide a concave groove portion (trench portion) dedicated for positioning and holding a hook and loop fastener on an inner surface of the mold, for example, as in Patent Document 1 as described above. Therefore, costs or workloads required to manufacture the mold for molding the cushion body can be significantly reduced as compared to the case of Patent Document 1 and thus the cushion body with the molded hook and loop fastener integrated can be efficiently manufactured at low costs.

When the molded hook and loop fastener of the present invention is constituted of one hook and loop fastener member, the resin material infiltration-blocking member, the resin material infiltration-blocking member includes right and left first frame portions continuously arranged over the entire length of the base material in the longitudinal direction and second frame portions arranged along the width direction of the hook and loop fastener member on both ends of the hook and loop fastener member in the longitudinal direction and configured to connect the right and left frame portions with each other.

Thus, when the molded hook and loop fastener of the present invention is set on the cavity surface formed as the single surface of the mold and then the cushion body is foamed, it is possible to stably prevent the foaming material from infiltrating into the engaging element region over the resin material infiltration-blocking member from the width direction of the molded hook and loop fastener and also from infiltrating into the engaging element region over the resin material infiltration-blocking member from the longitudinal direction of the molded hook and loop fastener. Accordingly, the molded hook and loop fastener integrated with the cushion body can stably ensure an engaging force (fastening force) inherent therein.

In this case, the resin material infiltration-blocking member is constructed of a single member having first frame portions and second frame portions integrally formed with each other. Thus, the resin material infiltration-blocking member can be simply constructed and also an operation of attaching the resin material infiltration-blocking member to the hook and loop fastener member can be facilitated, thereby allowing the molded hook and loop fastener of the present invention to be efficiently manufactured. In addition, as the first frame portions and the second frame portions are integrally formed with each other, strength of the resin material infiltration-blocking member can be stably ensured, and also infiltration of the foaming resin material can be effectively prevented by the first frame portions and the second frame portions.

Also, the resin material infiltration-blocking member includes a rectangular opening portion surrounded by the first frame portions and the second frame portions, and a dimension of the opening portion in the width direction is set to be smaller than a dimension between outer surfaces of the right and left support members and also a dimension of the opening portion in the longitudinal direction is set to be smaller than a dimension of the hook and loop fastener member in the longitudinal direction.

Thus, a relative positional offset of the opening portion of the resin material infiltration-blocking member in the molded hook and loop fastener is hardly occurred. Accordingly, upon foaming of the cushion body, infiltration of the foaming resin material into the engaging element region can be more stably prevented by the resin material infiltration-blocking member, and also parts of engaging elements or support members of the molded hook and loop fastener can be prevented from protruding (extending out) through the opening portion of the resin material infiltration-blocking member above the resin material infiltration-blocking member.

Also, according to the molded hook and loop fastener of the present invention, the sheet-shaped resin material infiltration-blocking member may have a tubular shape obtained by connecting side edge portions of the resin material infiltration-blocking member to each other and may be fixed to the right and left side edge portions of the base material. Thus, upon foaming of the cushion body, infiltration of the foaming resin material into the engaging element region can be more stably prevented by the resin material infiltration-blocking member.

In addition, when the molded hook and loop fastener member according to the present invention include a plurality of hook and loop fastener members and a flexible connection member for connecting the plurality of hook and loop fastener members along the longitudinal direction, the resin material infiltration-blocking member may include right and left first frame portions continuously arranged in the longitudinal direction over the plurality of hook and loop fastener members and second frame portions arranged in the width direction of the hook and loop fastener members to bridge between the adjacent hook and loop fastener members and configured to connect the right and left first frame portions with each other.

Thus, when the molded hook and loop fastener is configured to be bent in the width direction by connecting a plurality of hook and loop fastener members using the flexible connection member, because the resin material infiltration-blocking member has the first frame portions and second frame portions as described above, the molded hook and loop fastener can be ensured to be easily bent, and also it is possible to stably prevent the foaming resin material from infiltrating into the engaging element region over the resin material infiltration-blocking member from the width direction and longitudinal direction of the molded hook and loop fastener upon foaming of the cushion body.

Further, in this case, when the cushion body has been foamed, parts of the first frame portions and parts of the second frame portions of the resin material infiltration-blocking members can be embedded in the cushion body, so that a bonding strength (fixation strength) between the molded hook and loop fastener and the cushion body can be enhanced and also the molded hook and loop fastener can be strongly fixed to and integrated with the cushion body.

In this case, the resin material infiltration-blocking member is constructed of a single member having the first frame portions and second frame portions integrally formed with each other, and particularly the sheet-shaped resin material infiltration-blocking member has a constant width dimension over the entire length thereof in the longitudinal direction and is configured to cover the plurality of hook and loop fastener members over the entire width of the hook and loop fastener members in the width direction.

Thus, the resin material infiltration-blocking member can be simply constructed and also an operation of attaching the resin material infiltration-blocking member to the hook and loop fastener member can be facilitated, thereby allowing the molded hook and loop fastener of the present invention to be efficiently manufactured. In addition, as the first frame portions and the second frame portions are integrally formed with each other, strength of the resin material infiltration-blocking member can be stably ensured, and also infiltration of the foaming resin material can be effectively prevented by the first frame portions and the second frame portions. In addition, when the cushion body has been foamed, the second frame portions of the resin material infiltration-blocking member can be embedded over a broad area in the cushion body, thereby further enhancing a bonding strength (fixation strength) between the molded hook and loop fastener and the cushion body.

In addition, the connection member is configured to connect center portions, in the width direction, of the plurality of hook and loop fastener members to each other in the longitudinal direction on a lower surface of the resin material infiltration-blocking member. Thus, even if the second frame portions are arranged to bridge between the adjacent hook and loop fastener members, the molded hook and loop fastener member can be stably curved or meandered in the width direction. Also, when the cushion body has been foamed, regions, which bridge between the hook and loop fastener members, of the second frame portions of the resin material infiltration-blocking member and the connection member can be embedded in the cushion body, thereby more effectively enhancing a bonding strength between the molded hook and loop fastener and the cushion body.

Also, according to the molded hook and loop fastener of the present invention, the resin material infiltration-blocking member is configured to extend outward in the width direction beyond right and left end edges of the base material, so that when the cushion body has been foamed, the extension portion of the resin material infiltration-blocking member can be embedded in the cushion body. Thus, a bonding strength (fixation body) between the molded hook and loop fastener and the cushion body can be enhanced so that the molded hook and loop fastener can be strongly fixed to and integrated with the cushion body.

In addition, the resin material infiltration-blocking member is constructed of a non-woven fabric. Thus, as described above, the resin material infiltration-blocking member can be easily constructed and also an enhanced sealing ability of the resin material infiltration-blocking member against the cavity surface of the mold can be more stably obtained.

Furthermore, the right and left support members are constituted of wall members intermittently or continuously erected along a front and rear direction so that the engaging element region constituted of a plurality of engaging elements is interposed therebetween. Thus, the resin material infiltration-blocking member can be stably supported, so that even if a flowing pressure or foaming pressure of the foaming resin material is exerted thereon upon foaming of the cushion body, a positional offset of the resin material infiltration-blocking member can be prevented, thereby more effectively preventing the foaming resin material form infiltrating into the engaging element region over the resin material infiltration-blocking member.

Also, in this case, the wall members, which are intermittently or continuously erected along the front and rear direction, are arranged in multi rows in the width direction, so that the molded hook and loop fastener can be stably fixed in a suitable posture when the molded hook and loop fastener is set on the cavity surface of the mold. As a result, the resin material infiltration-blocking member can be stably closely contacted with the cavity surface of the mold. Further, for example, when the resin material infiltration-blocking member is closely contacted with the cavity surface so that the resin material infiltration-blocking member is sandwiched the support members and the cavity surface of the mold (see Embodiment 1 as described below), the resin material infiltration-blocking member can be closely contacted with the cavity surface over a broader area thereof, thereby more effectively preventing infiltration of the foaming resin material.

Also, according to the present invention, there is provided a method of manufacturing a cushion body, in which the molded hook and loop fastener having the configurations as described above is closely contacted with a fastener mount surface of a mold so that the first surface of the base material faces the fastener mount surface, and then foaming is performed so that the molded hook and loop fastener is integrated with the cushion body. By using such a cushion body manufacturing method, a cushion body with a molded hook and loop fastener, in which no foaming resin has infiltrated into the engaging element region of the hook and loop fastener member and thus a predetermined fastening force by engaging elements is ensured, can be stably manufactured.

Accordingly, when a surface of the cushion body manufactured according to the present invention is covered with a cover material and then engaging elements (female engaging elements) arranged on a back surface of the cover material are pressed toward engaging elements (male engaging elements) of the molded hook and loop fastener integrally molded with the cushion body, the cover material can be securely fastened along the surface of the cushion body, thereby preventing the cover material from being floated from the cushion body.

According to the cushion body manufacturing method of the present invention, the fastener mount surface of the mold is formed as a single surface and foaming of the cushion body is performed while the molded hook and loop fastener as described above is closely contacted with the single surface. Thus, even if the molded hook and loop fastener is closely contacted with the fastener mount surface formed as a single surface of the mold, infiltration of the foaming resin into the engaging element region of the molded hook and loop fastener can be prevented and thus the cushion body with the molded hook and loop fastener having a predetermined fastening force can be stably manufactured.

Also, because the molded hook and loop fastener can be closely contacted with the fastener mount surface formed as the single surface of the mold (particularly, a flat fastener mount surface), it is not necessary to provide a concave groove portion (trench portions) dedicated for positioning and holding the hook and loop fastener on the inner surface of the mold, for example, as in Patent Document 1 as described above. Also, for example, even if a position of the molded hook and loop fastener relative to the cushion is changed, it is not necessary to manufacture new molds on all such cases as in Patent Document 1 as described above. Accordingly, costs or workloads required to manufacture the mold for molding the cushion body can be significantly reduced as compared to the case of Patent Document 1 and thus the cushion body with the molded hook and loop fastener integrated can be efficiently manufactured at low costs.

EMBODIMENT OF INVENTION

Preferred embodiments of the present invention will be now described in detail with reference to the drawings.

Meanwhile, the present invention is not limited to the embodiments as described below, and various modifications thereof can be made as long as having substantially the same configuration as those of the invention and also obtaining the same functions and effects.

Embodiment 1

Figure 1:
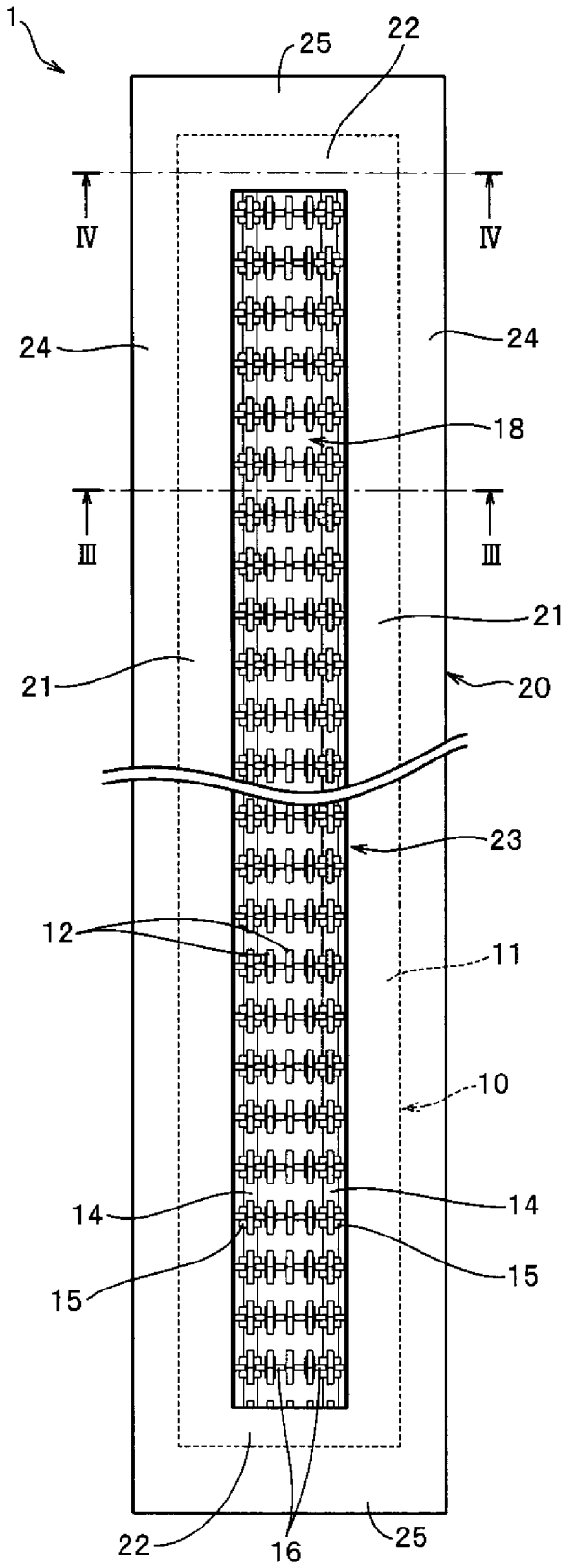
FIG. 1 is a plan view showing a molded hook and loop fastener according to an embodiment 1 of the present invention.
Figure 2:
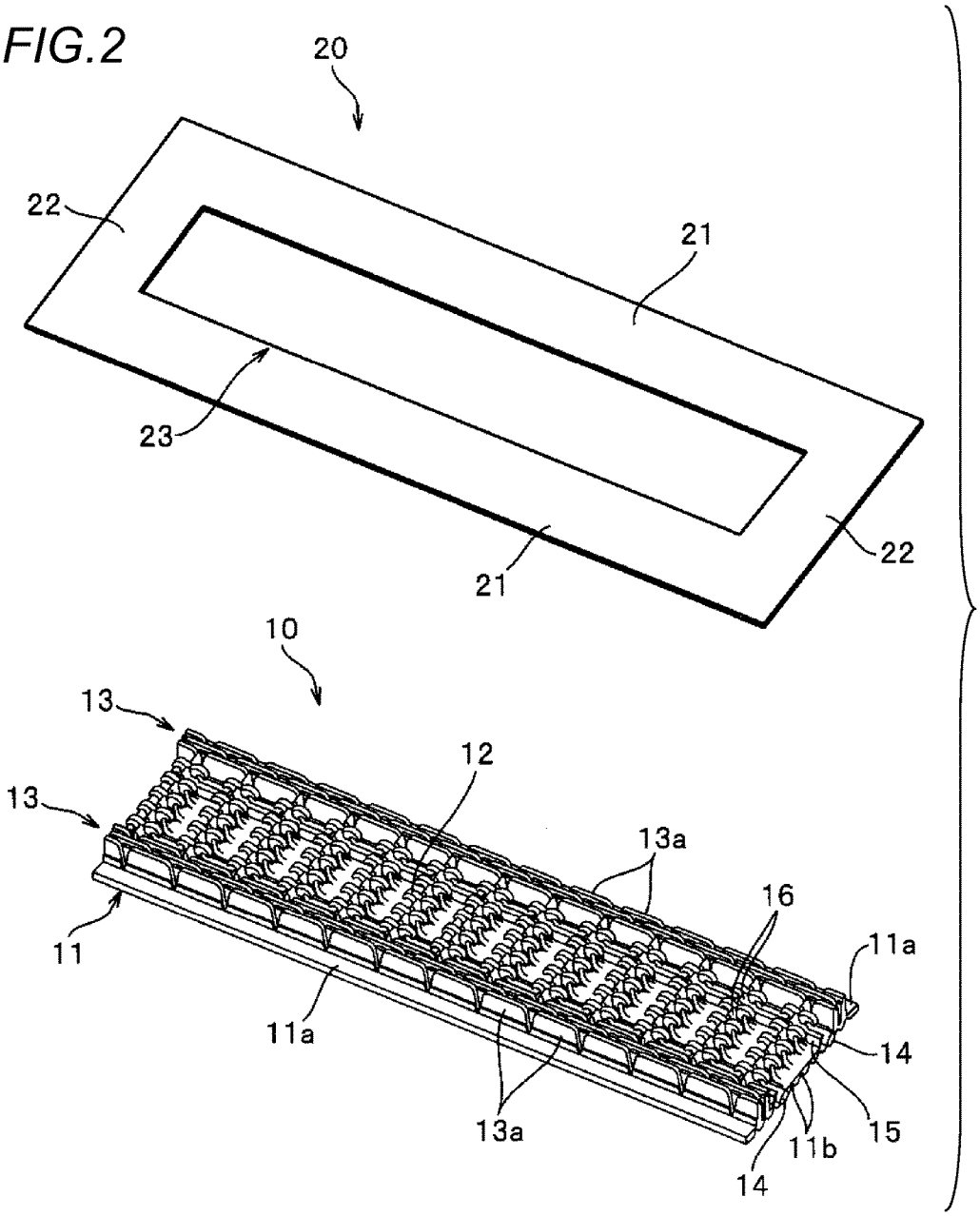
FIG. 2 is a perspective view showing a state of the molded hook and loop fastener before a resin material infiltration-blocking member is fixed to a hook and loop fastener member thereof.
Figure 3:
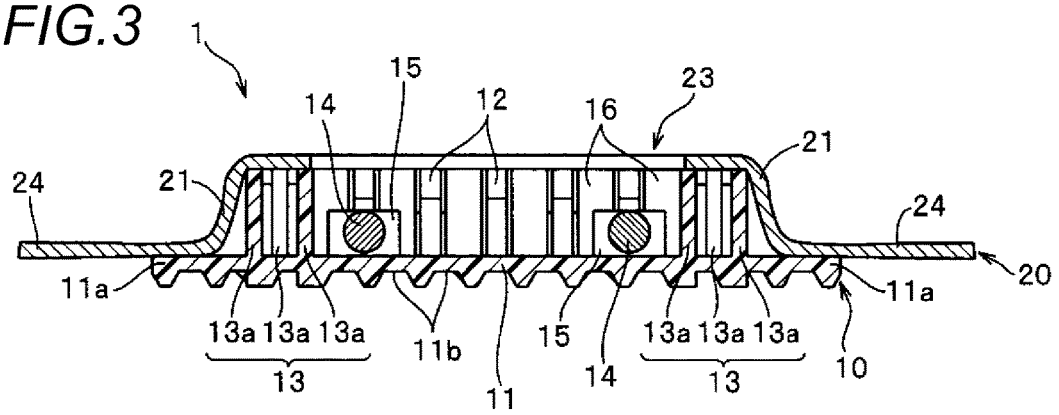
FIG. 3 is a sectional view taken along a III-III line shown in FIG. 1.
Figure 5:
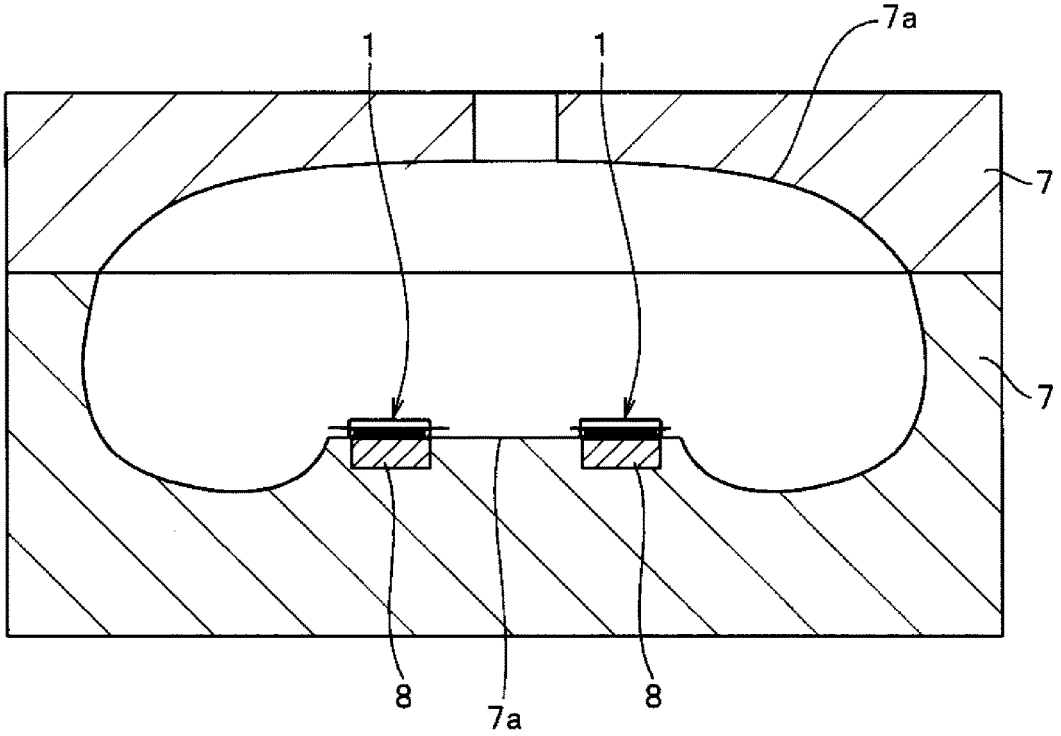
FIG. 5 is a sectional view showing a state where the molded hook and loop fastener is closely contacted with a cavity surface of a mold for molding a cushion body.

FIG. 1 is a plan view showing a molded hook and loop fastener according to the present embodiment 1 and FIG. 2 is a perspective view showing a state of the molded hook and loop fastener before a resin material infiltration-blocking member is fixed to a hook and loop fastener member thereof. Also, FIGS. 3 and 5 are sectional views taken a III-III line and a IV-IV line shown in FIG. 1.

Meanwhile, in the following description, a longitudinal direction of a base material of the molded hook and loop fastener is referred to as a front and rear direction and a width direction of the base material is referred to as a right and left direction. Also, a front and back direction of the base material is referred to as an upward and downward direction, and in particular, a direction toward a side on which engaging elements are arranged with respect to the base material is referred to as an upward direction and the opposite direction is referred to as a downward direction.

The molded hook and loop fastener 1 according to the present embodiment 1 includes one hook and loop fastener member 10 having a plurality of engaging elements 12 erected on an upper surface (first surface) of a base material 11 and a resin material infiltration-blocking member 20 fixed to the hook and loop fastener member 10 and having a frame shape.

The hook and loop fastener member 10 includes a flat plate-shaped base material 11, right and left support members 13 erected on the upper surface (first surface) of the base material 11 along the longitudinal direction (front and rear direction) thereof, a plurality of engaging elements (hook-shaped male engaging elements) 12 arranged between the right and left support members 13, two linear magnetic bodies 14 arranged along the front and rear direction, fixation portions 15 arranged on insides of the right and left support members 13 for fixing the linear magnetic bodies 14, and transversal wall bodies 16 arranged along the width direction.

The hook and loop fastener member 10 is formed by molding a thermoplastic resin material using a die wheel as described below. As a material for the hook and loop fastener member 10, a thermoplastic resin material, such as polyethylene, polypropylene, polyester, nylon, polybutylene terephthalate, or copolymer thereof, can be employed. Also, the linear magnetic bodies 14 are integrally fixedly molded on the fixation portions 15 by introducing the linear magnetic bodies 14 into portions where the fixation portions 15 of the hook and loop fastener member 10 are formed when the hook and loop fastener member 10 is molded.

In the present embodiment 1, the base material 11 has a rectangular thin board shape elongated in the front and rear direction (longitudinal direction) as viewed in the upward and downward direction and is configured to be bendable in the upward and downward direction (front and back direction). The base material 11 is arranged in a center region in the width direction and has a center region portion, on which the plurality of engaging elements 12 and the right and left support members 13 are erected, and right and left side edge portions 11*a* arranged outward in the width direction beyond locations where the right and left support members 13 are erected. Also, upper surfaces (first surface) of the right and left side edge portions 11*a* of the base material 11 is formed as a flat surface. In addition, right and left side edge ends of the base material 11 are formed to be parallel to each other along the longitudinal direction of the hook and loop fastener member 10.

On a lower surface (back surface) of the base material 11, a plurality of recessed groove portions 11*b* are provided to be parallel to each other along the front and rear direction. Because the base material 11 has such a plurality of recessed groove portions 11*b*, when the molded hook and loop fastener 1 is integrally molded with a cushion body (foam body) 6, as described below, upon foaming thereof, a bonded area between the base material 11 of the hook and loop fastener member 10 and the cushion body 6 can be increased, thereby enhancing fixation strength of the hook and loop fastener member 10 to the cushion body 6.

Alternatively, according to the present invention, in order to enhance fixation strength of the hook and loop fastener member 10 to the cushion body 6, instead of the plurality of recessed groove portions 11*b* as described above, for example, ridges, arrowhead-shaped protrusions or the like may be provided on the lower surface of the base material 11 or a non-woven fabric may be fixed thereto. Also, the lower surface of the base material 11 may be formed as a flat surface without being provided with the recessed groove portions 11*b* or the like as described above.

The right and left support members 13 are constructed by wall-shaped members erected along the front and rear direction at locations, where are located on the inside of right and left end edges of the base material 11 in the width direction (right and left direction), so that an engaging element region 18 constituted of the plurality of engaging elements 12 is interposed therebetween. Also, the right and left support members 13 are integrally molded with the base material 11.

According to the present embodiment 1, each of the right and left support members 13 has three longitudinal wall rows extending in the longitudinal direction and each of the longitudinal wall rows is constituted of a plurality of longitudinal wall bodies 13*a* intermittently arranged at a predetermined pitch along the longitudinal direction. Also, longitudinal wall connection portions for connecting longitudinal wall bodies 13*a* of the longitudinal wall rows, which are adjacent to each other in the width direction, are arranged in each support member 13.

The support member 13 may be any other members so far as the resin material infiltration-blocking member 20 can be supported, but each may preferably be at least one longitudinal wall member (longitudinal wall row) intermittently or continuously extending in the longitudinal direction. Namely, the support member 13 may be, for example, one or more longitudinal wall rows continuously erected along the longitudinal direction or, as described above, longitudinal wall members in which a plurality of longitudinal wall bodies intermittently arranged are arranged in a zigzag shape.

Herein, longitudinal wall bodies 13*a* of the longitudinal wall row, which is arranged most toward the engaging elements 12, of the support member 13 are referred to as a first row of longitudinal wall bodies 13*a*, longitudinal wall bodies 13*a* of the longitudinal wall row, which is arranged outward relative to the first row of longitudinal wall bodies 13*a*, are referred to as a second row of longitudinal wall bodies 13*a*, and longitudinal wall bodies 13*a* of the longitudinal wall row, which is arranged on the outermost side, are referred to as a third row of longitudinal wall bodies 13*a*. Meanwhile, in the present invention, structures of the right and left support members 13 are not particularly limited, and for example, formation of the longitudinal wall bodies 13*a*, which constitutes the support members 13 of the present embodiment 1, or the number of arrangement thereof (the number of longitudinal wall rows) may be modified in any other manners.

According to the present embodiment 1, longitudinal wall bodies 13*a* of each row are intermittently arranged at a predetermined attachment pitch in the longitudinal direction, and gaps are provided between adjacent longitudinal wall bodies 13*a* of each row in the longitudinal direction. Also, longitudinal wall bodies 13*a* of the second row are arranged to correspond to locations of gaps formed between adjacent longitudinal wall bodies 13*a* of the first and third row, so that longitudinal wall bodies 13*a* of the first to third rows are arranged in a zigzag shape to have a positional relationship that the longitudinal wall rows are offset relative to each other.

Also, the connection portions for longitudinal wall bodies 13*a* of the support members 13 are arranged between longitudinal wall bodies 13*a* of the first and third rows and longitudinal wall bodies 13*a* of the second rows and thus connect front and rear end portions of longitudinal wall bodies 13*a* of the first and third rows to center portions of longitudinal wall bodies 13*a* of the second row in the longitudinal direction. A height dimension (dimension in the upward and downward direction) of the connection portions is set to be lower than those of longitudinal wall bodies 13*a* of the first to third rows, and also a width dimension (dimension in the right and left direction) of the connection portions is set to have the same size as distances between longitudinal wall bodies 13*a* of the first and third rows and longitudinal wall bodies 13*a* of the second row in the width direction.

As the support members 13 according to the present embodiment 1 is configured as described above, gaps provided between adjacent longitudinal wall bodies 13*a* of each longitudinal wall row can be widened or narrowed and therefore the hook and loop fastener member 10 (molded hook and loop fastener 1) can be freely bent in the upward and downward direction.

Also, because the support members 13 are configured to have a plurality of longitudinal wall rows and also to be wide in the width direction, the resin material infiltration-blocking member 20 can be supported widely in the width direction on upper surfaces of the support members 13 when the resin material infiltration-blocking member 20 is fixed to the hook and loop fastener member 10 to be covered on the upper surfaces of the support members 13 as described below, thereby stabilizing a position of the resin material infiltration-blocking member.

Further, when the molded hook and loop fastener 1 is attracted and fixed to a cavity surface (fastener mount surface) 7*a* of a mold 7 as described below, the resin material infiltration-blocking member 20 can be sandwiched widely in the width direction between the support members 13 and the cavity surface 7*a* of the mold 7. Accordingly, the resin material infiltration-blocking member 20 can be widely, stably and closely contacted with the upper surface portions of the support members 13, and also the resin material infiltration-blocking member 20 can be widely, stably and closely contacted with the cavity surface 7*a* of the mold 7. As a result, sealing ability by the resin material infiltration-blocking member 20 (i.e., sealing ability between the hook and loop fastener member 10 and the cavity surface 7*a*, between which the resin material infiltration-blocking member 20 is sandwiched) can be greatly enhanced.

The engaging elements 12 are erected on the upper surface of the base material 11 to be aligned at a predetermined attachment pitch in the longitudinal direction and the width direction, thereby obtaining an engaging force with respect to a cover material covered on the cushion body 6. In particular, in the case of the present embodiment 1, longitudinal rows of engaging elements 12 aligned along the longitudinal direction are arranged to be arrayed in five rows in the width direction between the right and left support members 13.

In this case, the engaging element region 18 in the hook and loop fastener member 10 is formed by a portion surrounded by the right and left support members 13, a transversal support portion 16*a*, which is constituted together with the engaging elements 12 by transversal wall bodies 16 arranged on the front-most side as described below, and a transversal support portion 16*a*, which is constituted together with the engaging elements 12 by transversal wall bodies 16 arranged on the rear-most side.

Also, each engaging element 12 has an erection portion perpendicularly erected from the upper surface of the base material 11 and a hook-shaped engaging head portion branched and curved in the front and rear direction at an upper end of the erection portion. In addition, a height dimension (dimension in the upward and downward direction) of each engaging element 12 as measured from the upper surface of the base material 11 is set to have the same size as a height dimension (height dimension of the longitudinal wall bodies 13*a*) of the support members 13. Meanwhile, in the present invention, a shape, a dimension, an installing pitch and the like of the engaging elements 12 are not particularly limited and thus can be modified in any other manners.

Figure 4:
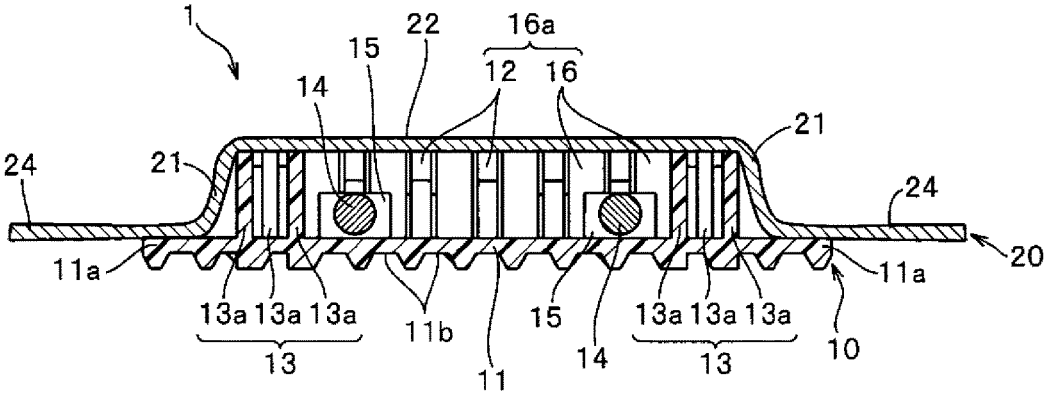
FIG. 4 is a sectional view taken along a IV-IV line shown in FIG. 1.

The transversal wall bodies 16 are erected along the width direction between the support members 13 and the engaging elements 12 and also between engaging elements 12 adjacent to each other in the width direction. In this case, the transversal wall bodies 16 are connected with engaging elements 12, which are arranged to be adjacent thereto, via a lower end portion (end portion located toward the base material 11) thereof (see FIGS. 3 and 4). As the transversal wall bodies 16 and the engaging elements 12 are connected with each other in this way, the transversal wall bodies 16 and the engaging elements 12 are configured to reinforce each other. Alternatively, according to the present invention, the transversal wall bodies 16 and the engaging elements 12 may be formed to be spaced from each other.

Also, a plurality of transversal wall bodies, which are arranged along the width direction on the front-most and rear-most sides of the hook and loop fastener member 10, together with engaging elements 12, which are arranged to be sandwiched between the transversal wall bodies 16, constitutes the transversal support portions 16*a* for supporting a back side of a transversal frame portion (second frame portion) 22, as described below, of the resin material infiltration-blocking member 20 along the width direction.

In addition, a height dimension of each transversal wall body 16 as measured from the upper surface of the base material 11 is set to have the same size as height dimensions of the longitudinal wall bodies 13*a* and the engaging elements 12. Namely, in the present embodiment 1, upper ends of the longitudinal wall bodies 13*a*, the transversal wall bodies 16 and the engaging elements 12 are arranged on the same plane. Accordingly, when longitudinal frame portions (first frame portion) 21 and transversal frame portions (second frame portion) 22 of the resin material infiltration-blocking member 20 as described below are mounted on upper end surfaces of the support members 13 and upper end surfaces of the transversal wall bodies 16*a*, height positions of each mounted portion of the resin material infiltration-blocking member 20 can be matched (coincided) with each other.

Thus, when the molded hook and loop fastener 1 of the present embodiment 1 is mounted, for example, on a flat cavity surface 7*a* of the molding mold 7 so that the engaging elements 12 are oriented toward a direction away from the cavity surface 7*a* (see FIG. 5), the longitudinal frame portion 21 and the transversal frame portion 22 of the resin material infiltration-blocking member 20 can be stably and closely contacted with the cavity surface 7*a*, thereby preventing a gap from being formed between the cavity surface 7*a* and the hook and loop fastener member 10, between which the resin material infiltration-blocking member 20 is sandwiched.

The linear magnetic bodies 14 are fixed in the engaging element region 18 of the hook and loop fastener member 10 along rows of engaging elements 12, which are arranged to be closest to the right and left support members 13, while interposing the fixation portions 15 arranged on the upper surface of the base material 11. The linear magnetic bodies 14 have a circular cross-section and are constructed of magnetically attracted or attracting materials.

Because the linear magnetic bodies 14 are arranged on the molded hook and loop fastener 1, when the cushion body 6 is molded using the mold 7 having magnets 8 arranged on the cavity surface 7*a* or on the vicinity of the cavity surface 7*a* as described below, a magnetic force generated between the magnets 8 of the mold 7 and the linear magnetic bodies 14 of the molded hook and loop fastener 11 can be used to stably suck and fix the molded hook and loop fastener 1 to the cavity surface 7*a* of the mold 7.

In this cast, as magnetically attracted materials for the linear magnetic bodies 14, monofilaments, in which magnetic particles made of alloys of iron, cobalt, nickel or the like are mixed to a synthetic resin such as polyester, twisted metal yarns, in which a number of fine metal wires made of such alloys are bundled and twisted, or the like can be used. On the other hand, as magnetically attracting materials for the linear magnetic bodies 14, magnetized wire materials, particularly, linear metal linear magnets, rubber magnets, which are magnetized by mixing magnetic iron oxide to rubber, or the like can be used. Also, according to the present invention, fine tape-shaped magnetic bodies may be used instead of linear magnetic bodies.

The fixation portions 15 for fixing the linear magnetic bodies 14 to the base material 11 are arranged inside of and in the vicinity of the support members 13 to extend along the longitudinal direction with a predetermined space and are configured to protrude in a rectangular cross-sectioned block shape from the upper surface of the base material 11. The linear magnetic bodies 14 are embedded in the fixation portion 15 to extend through the fixation portions 15 along the longitudinal direction. Also, each of the fixation portions 15 is integrally constructed with the engaging elements 12 and the transversal wall bodies 16 erected from the base material 11.

Alternatively, according to the present invention, for example, the fixation portions 15 may be arranged on the lower surface of the base material 11 so that the linear magnetic bodies 14 are fixed to the lower surface of the base material 11. Also, instead of fixing the linear magnetic bodies 14 to the base material 11, a magnetic property may be imparted to the hook and loop fastener member 10 by mixing or kneading magnetic particles to a synthetic resin constructing the hook and loop fastener member 10.

The resin material infiltration-blocking member 20 fixed to the hook and loop fastener member 10 is constructed of a flexible thin piece-shaped sheet member, and in particular the resin material infiltration-blocking member 20 according to the present embodiment 1 is constructed of a non-woven fabric having a predetermined thickness. Because the resin material infiltration-blocking member 20 is constructed of a non-woven fabric, suitable flexibility, pliability and swollen feeling can be imparted to the resin material infiltration-blocking member 20.

Accordingly, in a foaming process of the cushion body 6 as described below, when the resin material infiltration-blocking member 20 is attracted and fixed to the cavity surface 7*a* of the mold 7 using a magnetic force, the resin material infiltration-blocking member 20 having flexibility or pliability can be properly deformed so that sealing ability between the resin material infiltration-blocking member 20 and the cavity surface 7*a* of the mold 7 can be enhanced. Alternatively, according to the present invention, the material of the resin infiltration-blocking member 20 is not limited thereto, and thus the resin material infiltration-blocking member 20 may be constructed, for example, of a knitted or woven thin cloth piece or the like.

Also, as shown in FIGS. 1 and 2, the resin material infiltration-blocking member 20 of the present embodiment 1 is constructed of a frame-shaped single sheet member. Namely, the resin material infiltration-blocking member 20 integrally has right and left longitudinal frame portions (first frame portions) 21 arranged along the longitudinal direction of the molded hook and loop fastener 1 and transversal frame portions (second frame portions) 22 arranged along the width direction to correspond to locations of front and rear end portions of the hook and loop fastener member 10 and configured to connect the right and left longitudinal frame portions 21 with each other, and also a rectangular opening portion 23 is formed in a center portion of the resin material infiltration-blocking member 20, which is surrounded by the right and left longitudinal frame portions 21 and the front and rear transversal frame portions 22.

This frame-shaped resin material infiltration-blocking member 20 is fixed to the hook and loop fastener member 10 by bonding or welding back surfaces of the right and left longitudinal frame portions 21 to the right and left side edge portions 11*a* of the base material 11 of the hook and loop fastener member 10 while protruding inner peripheral edge portions (peripheral edge portion of the opening portion 23) of the right and left longitudinal frame portions 21 and front and rear transversal frame portions 22 of the resin material infiltration-blocking member 20 above upper end locations of the support members 13.

In particular, according to the present embodiment 1, the resin material infiltration-blocking member 10 is fixed to the hook and loop fastener member 10 so that parts of the right and left longitudinal frame portions 21 are covered on the upper surfaces of the support members 13 and also parts of the front and back transversal frame portions 22 are covered on upper surfaces of the transversal support portions 16*a* arranged on the front-most and rear-most sides of the hook and loop fastener member 10.

At this time, because the right and left longitudinal frame portions 21 of the resin material infiltration-blocking member 20 are supported by the right and left support members 13, the longitudinal frames 21 are hardly collapsed or bend even if a flowing pressure or foaming pressure of a foaming resin material is exerted thereon when the cushion body 6 is foamed as described below. Also, the state where the inner peripheral edge portions of the longitudinal frame portions 21 are protruded above the upper end locations of the support members 13 can be stably kept.

In the present embodiment 1, a length dimension of the resin material infiltration-blocking member 20 (i.e., a dimension of the longitudinal frame portions 21 in the front and rear direction) is set to be larger than a length dimension of the base material 11 of the hook and loop fastener member 10 when the resin material infiltration-blocking member 20 is in a flat state before being attached to the hook and loop fastener member 10. In particular, in the case of the present embodiment 1, even when the resin material infiltration-blocking member 20 is in a state after being fixed to the hook and loop fastener member 10 and thus being partially bent, the resin material infiltration-blocking member 20 is set to have a length dimension larger than that of the base material 11 of the hook and loop fastener member 10.

Also, a width dimension of the resin material infiltration-blocking member 20 (i.e., a dimension between outer side edges of the right and left longitudinal frame portions 21 in the width direction) is set to be larger than a width dimension of the base material 11 of the hook and loop fastener member 10 when the resin material infiltration-blocking member 20 is in a flat state before being attached to the hook and loop fastener member 10. In particular, in the case of the present embodiment 1, even when the resin material infiltration-blocking member 20 is in a state after being fixed to the hook and loop fastener member 10 and thus being partially bent, the resin material infiltration-blocking member 20 is set to have a width dimension larger than that of the base material 11 of the hook and loop fastener member 10.

Namely, when being fixed to the hook and loop fastener member 10, the resin material infiltration-blocking member 20 of the present embodiment 1 has right and left first extension portions 24 extending outward beyond right and left end edges of the base material 11 of the hook and loop fastener member 10 and front and rear second extension portions 25 extending outward beyond front and rear end edges of the base material 11 of the hook and loop fastener member 10.

In addition, the rectangular opening portion 23 formed in the center portion of the resin material infiltration-blocking member 20 has a length dimension smaller than the length dimension of the base material 11 of the hook and loop fastener member 10 and also has a width dimension smaller than a dimension as measured between outer wall surfaces of the right and left support members 13 in the width direction (i.e., a dimension as measured between the left outermost wall surface of the left support member 13 and the right outmost wall surface of the right support member 13 in the width direction).

As the opening portion 23 of the resin material infiltration-blocking member 20 is set to have such a size, a positional offset of the opening portion 23 of the resin material infiltration-blocking member 20 relative to the engaging element region 18 of the hook and loop fastener member 10 can be hardly occurred. In addition, because the positional offset of the opening portion 23 is hardly occurred, it is possible to prevent, for example, parts of engaging elements 12 or support members 13 from protruding (extending) above the resin material infiltration-blocking member 20 from the opening portion 23, and as a result, a close contact ability of the resin material infiltration-blocking member to the cavity surface 7*a* of the mold 7 upon foaming of the cushion body 6 can be enhanced.

Then, the hook and loop fastener member 10 of the molded hook and loop fastener 1 of the present embodiment 1 having configurations as described above is manufactured, for example, using a manufacturing apparatus as described below.

Specifically, the manufacturing apparatus for the hook and loop fastener member 10, if not shown, includes a die wheel driven to be rotated in one direction, a continuous extruding nozzle for a molten resin arranged to face a peripheral surface of the die wheel, a picking-up roll arranged downstream of the continuous extruding nozzle in a rotation direction of the die wheel to face the peripheral surface of the die wheel, a linear magnetic body supply unit arranged upstream of the continues extruding nozzle in the rotation direction of the die wheel and configured to introduce linear magnetic bodies 14 between facing surfaces of the die wheel and the continuous extruding nozzle, and a cutting unit for cutting a continuous hook and loop fastener member 10, which is peeled off from the peripheral surface of the die wheel, at a predetermined length.

In the peripheral surface of the die wheel equipped in the manufacturing apparatus, molding cavities for molding engaging elements 12, right and left support members 13 and transversal wall bodies 16 and the like of the hook and loop fastener member 10 as described above is formed. Also, the die wheel is configured so that a coolant can flow through the inside of the die wheel, and below the die wheel, a coolant bath is arranged so that a lower half of the die wheel can be dipped therein.

When the hook and loop fastener member 10 of the present embodiment 1 is manufactured using the manufacturing apparatus as described above, a molten resin material is continuously extruded from the continuous extruding nozzle toward the peripheral surface of the die wheel. At this time, because the die wheel is driven to be rotated in one direction, the molten resin extruded on the peripheral surface thereof forms the base material 11 and the like of the hook and loop fastener member 10 by the continuous fastener nozzle and the die wheel, and at the same time successively forms the engaging elements 12, the right and left support members 13, the transversal wall bodies 16 and the like by the molding cavities as described above.

Also, at the same time as when the molten resin material is extruded from the continuous extruding nozzle, the linear magnetic bodies 14 are supplied from the supply unit to an extrusion location of the molten resin to be integrally molded with the continuous hook and loop fastener member 10.

The continuous hook and loop fastener member 10 molded on the peripheral surface of the die wheel is solidified by half-turning while being carried and cooled on the peripheral surface of the die wheel and then is continuously peeled off from the peripheral surface of the die wheel by the picking-up roll.

Then, the continuous hook and loop fastener member 10 (in other words, continuous body of hook and loop fastener member 10) peeled off from the die wheel is conveyed toward the cutting unit and is cut at a predetermined length by the cutting unit. Thus, as shown in FIG. 2, the hook and loop fastener member 10 having the predetermined length is manufactured. Meanwhile, in the present invention, the manufacturing apparatus or manufacturing method for the hook and loop fastener member 10 is not particularly limited and thus can be modified in any other manners.

Subsequently, the frame-shaped resin material infiltration-blocking member 20 is covered on the upper surface of the hook and loop fastener member 10 of the present embodiment 1 manufactured as described above and then is fixed to the right and left side edge portions 11*a* of the base material 11 of the hook and loop fastener 10, thereby manufacturing the molded hook and loop fastener 1 of the present embodiment 1 as shown in FIG. 1.

At this time, the resin material infiltration-blocking member 20 is attached to the hook and loop fastener member 10 in such a manner that the resin material infiltration-blocking member 20 is covered on the upper surface of the hook and loop fastener member 10 to align a position of the opening portion 23 of the resin material infiltration-blocking member 20 to a position of the engaging element region 18 of the hook and loop fastener member 10 and also lower surfaces (back surfaces) of the right and left longitudinal frame portions 21 of the resin material infiltration-blocking member 20 are fixed to upper surfaces of the right and left side edge portions 11*a* of the base material 11. In this case, as a means for fixing the longitudinal frame portions 20 of the resin material infiltration-blocking member 20 to the right and left side edge portions 11*a* of the base material 11, bonding with an adhesive or welding, such as high frequency welding or thermal welding, can be employed.

For example, when a cushion body (foam body) 6 for seats and the like of a vehicle is foamed, the molded hook and loop fastener 1 of the present embodiment 1 using the method as described above is integrated with the cushion body 6 by molding (two-color molding).

Specifically, first, the manufactured molded hook and loop fastener 1, as shown in FIG. 5, is mounted on a fastener mount surface formed at a predetermined location on the cavity surface 7*a* of the cushion body molding mold 7.

At this time, the fastener mount surface, on which the molded hook and loop fastener 1 is mounted (set), of the cavity surface 7*a* of the mold 7 is configured as a flat surface, which is a single surface. Alternatively, the fastener mount surface may be configured as a curved surface, which is a convex or concave-shaped single surface. Also, in the interior of the mold 7, magnets 8, such as neodymium magnets, are embedded to correspond to a position of the fastener mount surface on which the molded hook and loop fastener 1 is to be mounted.

Accordingly, the molded hook and loop fastener 1 is mounted so that a surface (upper surface), on which the engaging elements 12 of the base material 11 are formed is oriented to face the fastener mount surface of the mold 7, and thus the linear magnetic bodies 14 arranged in the molded hook and loop fastener 1 are attracted by an attraction force of the magnets 8 so that the molded hook and loop fastener 1 is attracted and fixed to the flat cavity surface (fastener mount surface) 7*a* of the mold 7.

In this case, particularly, a self-alignment effect, which can automatically precisely align the molded hook and loop fastener 1 to a predetermined position, can be also obtained by using a magnetic force generated between the magnets 8 and the linear magnetic bodies 14 of the molded hook and loop fastener 1.

Also, the molded hook and loop fastener 1 of the present embodiment 1 is held in a state where parts of the resin material infiltration-blocking member 20, particularly parts, which are mounted on upper surfaces of the right and left support members 13 of the hook and loop fastener member 10 and upper surfaces of the transversal support portions 16*a* constituted of the transversal wall bodies 16 and the engaging elements 12, of the resin material infiltration-blocking member 20, are closely contacted with the flat cavity surface (fastener mount surface) 7*a* of the mold 7.

Alternatively, in the present invention, the fastener mount surface of the mold 7 may formed in a concave groove shape and the molded hook and loop fastener 1 may be attracted and fixed to the fastener mount surface so that engaging elements 12 or support members of the molded hook and loop fastener 1 are inserted in the concave groove. In this case, parts, which are fixed to the right and left side edge portions of the base material 11, of the resin material infiltration-blocking member 20 can be closely contacted with the cavity surface of the mold 7.

Subsequently, after the molded hook and loop fastener 1 of the present embodiment 1 is attracted and fixed to a predetermined position (fastener mount surface) on the cavity surface 7*a* of the mold 7 as described above, a foaming resin material is sprayed and injected into the interior of the mold 7 from a spraying nozzle, not shown. At this time, for example, by spraying the foaming resin material while moving the spraying nozzle relative to the mold 7, the foaming resin material can be injected throughout the cavity space of the mold 7. In addition, after a predetermined amount of the foaming resin material is sprayed from the spraying nozzle, the mold 7 is clamped. Thus, as the foaming resin material is foamed to be widely expanded throughout the entire cavity space of the mold, the cushion body 6 is molded.

At this time, because the molded hook and loop fastener 1 is positioned and fixed to the predetermined position by attraction action of the magnets 8 embedded in the mold 7, there is no case where the position of the molded hook and loop fastener 1 is displaced due to a flowing pressure or foaming pressure of the foaming resin material or the like.

Also, because the resin material infiltration-blocking member 20 of the molded hook and loop fastener 1 of the present embodiment 1 is configured so that an upper end portion thereof protruding above upper end locations of the support members 13 is sandwiched between the supper members 13 and the cavity surface 7*a* of the mold 7 and is more closely contacted with the cavity surface 7*a* of the mold 7 in the front and rear direction and the right and left direction than that in the engaging element region 18 formed in the hook and loop fastener member 10, a gap, which could allow the foaming resin material to pass therethrough, is not formed between the hook and loop fastener member 10 and the cavity surface 7*a*, between which the resin material infiltration-blocking member 20 is interposed.

In particular, in the present embodiment 1, as described above, because each support member is constructed widely in the width direction by three longitudinal wall rows, the resin material infiltration-blocking member 20 can be sandwiched widely in the width direction between the support members 13 and the cavity surface 7*a* of the mold 7. Accordingly, an enhanced sealing ability between the hook and loop fastener member 10 and the cavity surface 7*a* can be ensured by sandwiching the resin material infiltration-blocking member 20 therebetween.

Also, because the resin material infiltration-blocking member 20 is fixed to the hook and loop fastener member 10 in a state where the right and left longitudinal frame portions 21 are supported by the right and left support members 13, a positional offset of the resin material infiltration member 20 can be prevented even if a flowing pressure or foaming pressure of the foaming resin material is exerted thereon and thus the resin material infiltration-blocking member 20 can be stably kept closely contacted with the cavity surface 7*a* of the mold 7. Therefore, the engaging element region 18 of the molded hook and loop fastener 1 attracted and fixed to the cavity surface 7*a* of the mold 7 can be stably blocked from a region exterior of the molded hook and loop fastener (i.e., the cavity space) by the resin material infiltration-blocking member 20.

In particular, in the present embodiment 1, because the resin material infiltration-blocking member 20 is constructed of a non-woven fabric which is pliable and has a proper swollen feeling, even if the cavity surface 7*a* of the mold 7 has a very small unevenness, the resin material infiltration-blocking member 20 can be securely closely contacted with the cavity surface 7*a* of the mold 7 by causing the molded hook and loop fastener 1 to be attracted and fixed to the magnets 8, thereby preventing a gap from being formed between the resin material infiltration-blocking member 20 and the cavity surface 7*a*.

Thus, for example, even if the foaming resin material is strongly collided against the molded hook and loop fastener 1 when the foaming resin material is sprayed from the spraying nozzle, not shown, a flowing pressing or foaming pressure of the foaming resin material is high or the foaming resin material has a low viscosity, it is possible to effectively prevent the foaming material from passing between the resin material infiltration-blocking member 20 and the cavity surface 7*a* of the mold 7 and then infiltrating into the engaging element region 18 of the molded hook and loop fastener 1.

Therefore, in the engaging element region 18 of the molded hook and loop fastener 1, the engaging elements 12 are not potted with the foaming body, so that the engaging elements 12 can be stably exposed on the upper surface of the base material 11. Accordingly, a predetermined engaging force (fastening force) inherent in the molded hook and loop fastener 1 itself can be stably kept even after foaming of the cushion body 6.

In addition, the molded hook and loop fastener 1 of the present embodiment 1 is configured so that the right and left side edge portions 11 are formed to protrude on right and left outsides of the support members 13 and also the resin material infiltration-blocking member 20 includes right and left first extension portions 24 extending outward beyond right and left end edges of the base material 11 and front and rear second extension portions 25 extending outward beyond front and rear end edges of the base material 11.

Accordingly, when the foaming material is sprayed form the spraying nozzle, the right and left side edge portions 11*a* of the base material 11 and the first and second extension portions 24 and 25 of the resin material infiltration-blocking member 20 are acted as canopies as described above. As a result, it is possible to prevent the sprayed foaming resin material from being directly strongly hit between the resin material infiltration-blocking member 20 and the cavity surface 7*a* and also to effectively prevent the foaming resin material from infiltrating into the engaging element region 18.

Figure 6:
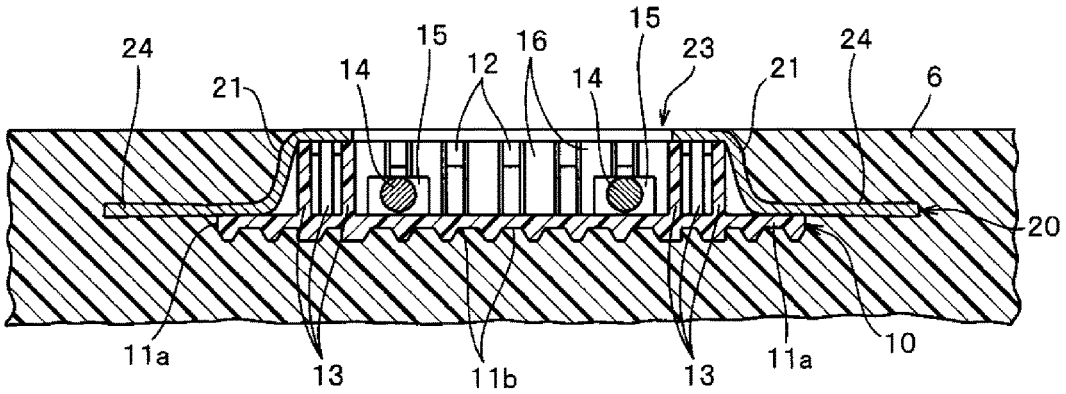
FIG. 6 is a sectional view showing a cushion body having a molded hook and loop fastener integrated therewith.

Then, as the foaming resin material is foamed and solidified in the cavity space of the mold 7 and thus molding is ended, the cushion body 6 integrated with the molded hook and loop fastener 1 of the present embodiment 1 as shown in FIG. 6 can be obtained.

The cushion body 6 with the molded hook and loop fastener 1 manufactured as described above can stably ensure a desired fastening force by a plurality of engaging elements 12 exposed on the upper surface thereof, because the foaming body has not infiltrate into the engaging element region 18 of the molded hook and loop fastener 1. Thus, a surface of the obtained cushion body 6 is covered with a cover material, not shown and then the cover material is pressed toward a location on the cushion body 6, at which the molded hook and loop fastener 1 is attached, and as a result, female engaging elements 12 arranged on a back surface of the cover material can be securely engaged with the engaging elements 12 (male engaging elements) of the molded hook and loop fastener 1. Thus, the cover material can be precisely attached along the surface of the cushion body 6 without being floated from the cushion body 6.

Further, in the molded hook and loop fastener 1 of the present embodiment 1, because the cushion body 6 can be foamed while the molded hook and loop fastener 1 is attracted and fixed to the cavity surface 7*a* of the mold 7 as described above, it is not necessary to provide a concave groove portion dedicated for positioning and holding the hook and loop fastener on the inner surface of the mold, for example, as in Patent Document 1 as described above. Accordingly, costs or workloads required to manufacture the mold 7 for molding the cushion body 6 can be significantly reduced as compared to the case of Patent Document 1 and thus the cushion body 6 with the molded hook and loop fastener 1 can be efficiently manufactured at low costs.

In addition, in the cushion body 6 with which the molded hook and loop fastener 1 of the present embodiment 1 is integrated, the foaming resin is infiltrated into parts of the resin material infiltration-blocking member 20 made of a non-woven fabric. Also, the first and second extension portions 24 and 25 of the resin material infiltration-blocking member 20 extending from the base material 11 in the molded hook and loop fastener 1 are embedded in the cushion body 6 as shown in FIG. 6. Accordingly, a bonding strength (fixation strength) between the molded hook and loop fastener 1 and the cushion body 6 can be effectively increased, so that the molded hook and loop fastener 1 can be more strongly integrated with the cushion body 6. In this case, the resin material infiltration-blocking member 20, into which the foaming resin is infiltrated, has a semi-rigidity to be bent together with the cushion body 6.

Further, the present embodiment 1 is configured so that in addition to transversal support portions 16*a*, transversal wall bodies 16 are also arranged between engaging elements 12 in the engaging element region 18 of the molded hook and loop fastener 1. Accordingly, for example, even when the continuous body of hook and loop fastener member 10 molded using the die wheel as described above is cut at any location and thus the hook and loop fastener member 10 having any length is manufactured, a resin material infiltration-blocking member 20 having an opening portion 23, which is adjusted to correspond to the length of the hook and loop fastener member 10, can be prepared and then fixed to the hook and loop fastener member 10, thereby allowing the molded hook and loop fastener 1 of the present embodiment 1 having any length to be simply manufactured.

Embodiment 2

Figure 7:
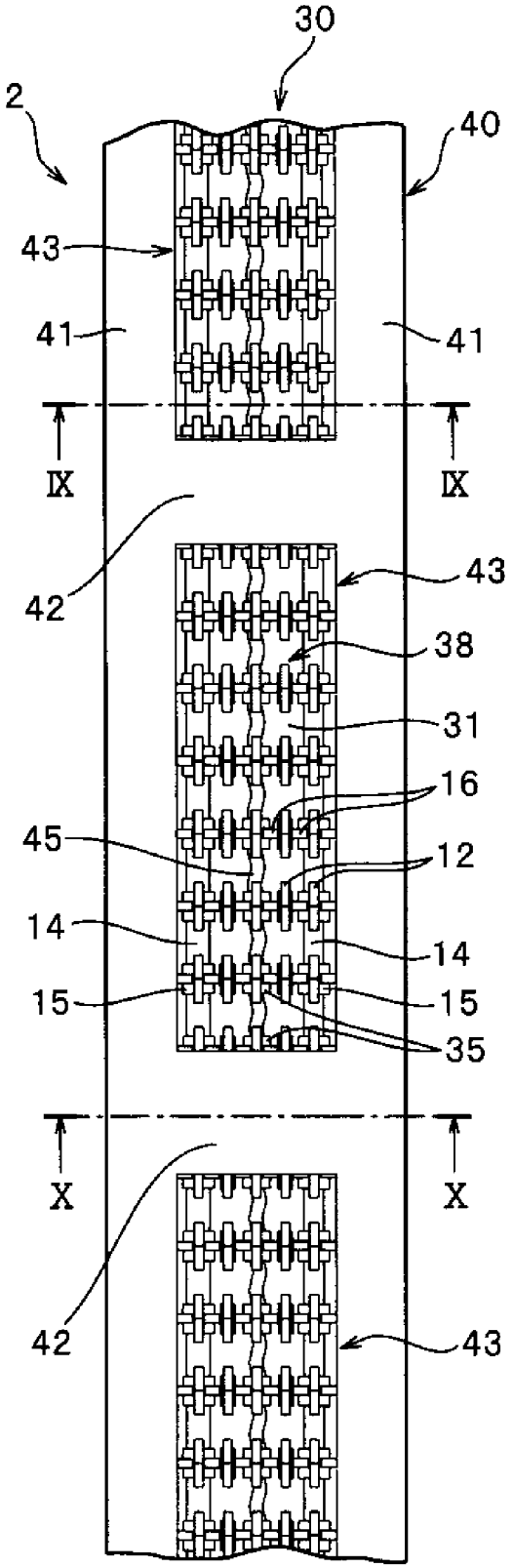
FIG. 7 is a plan view showing a molded hook and loop fastener according to an embodiment 2 of the present invention.
Figure 8:
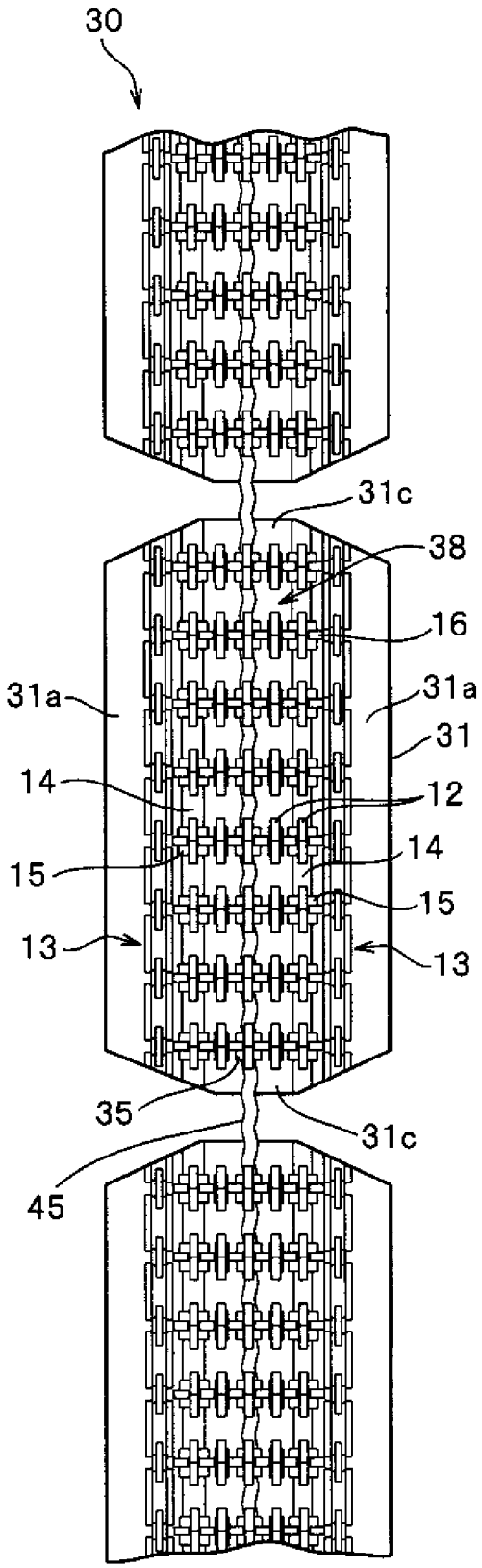
FIG. 8 is a plan view showing a hook and loop fastener member of the molded hook and loop fastener member.
Figure 9:
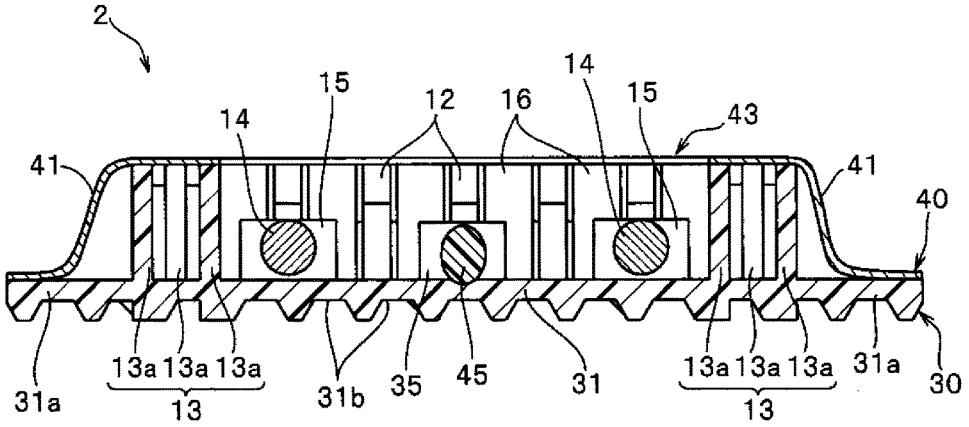
FIG. 9 is a sectional view taken along a IX-IX line shown in FIG. 7.
Figure 10:
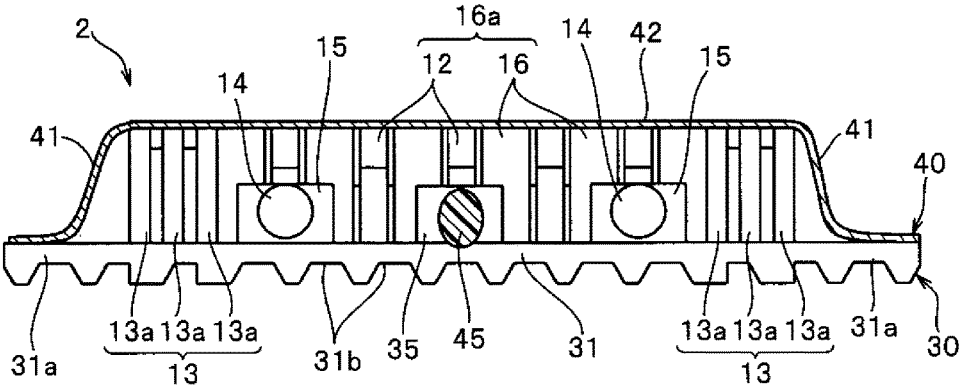
FIG. 10 is a sectional view taken along a X-X line shown in FIG. 7.

FIG. 7 is a plan view showing a molded hook and loop fastener according to the present embodiment 2 and FIG. 8 is a plan view showing a hook and loop fastener member of the molded hook and loop fastener member. Also, FIGS. 9 and 10 are sectional views taken along a IX-IX line and a line X-X shown in FIG. 7.

Meanwhile, with respect to molded hook and loop fasteners 2 to 5 according to the present embodiment 2 as described below and the following embodiments 3 to 5, configurations different from those of the molded hook and loop fastener 1 of the forgoing embodiment 1 will be primarily described, and thus components and members having substantially the same configurations as those of the molded hook and loop fastener 1 of the foregoing embodiment 1 are designated as the same reference numerals and the descriptions thereof will be omitted.

The molded hook and loop fastener 2 according to the present embodiment 2 includes a plurality of hook and loop fastener members 30 each having a plurality of engaging elements 12 erected on an upper surface (first surface) of a flat plate-shaped base material 31, a monofilament 45 as a connection member for connecting the adjacent hook and loop fastener members 30 with each other in the front and rear direction, and a resin material infiltration-blocking member 40 fixed across the plurality of hook and loop fastener members 30.

Also, each hook and loop fastener member 30 includes a base material 31 having a generally octagonal shape elongated in a longitudinal direction (front and rear direction) thereof as viewed from the front, right and left support members 13 erected on the upper surface (first surface) of the base material 31 along the longitudinal direction, a plurality of engaging elements 12 arranged between the right and left support members 13, two linear magnetic bodies 14 arranged along the front and rear direction, fixation portions (first fixation portions) 15 arranged on insides of the right and left support members 13 for fixing the linear magnetic bodies 14, fixation portions (second fixation portions) 35 for fixing the monofilament 45, which is the connection member, and transversal wall bodies 16 arranged along the width direction.

Meanwhile, in the present embodiment, engaging elements 12, right and left support members 13, linear magnetic bodies 14, fixation portion (first fixation portion) 15 for fixing the linear magnetic bodies 14 and transversal wall bodies 16 are respectively configured in the same manner as those of the forgoing embodiment 1. Also, transversal support portions 16*a* for support back sides of transversal frame portions (second frame portions) 42, as described above, of the resin material infiltration-blocking member 40 are constituted of a plurality of engaging elements 12 and a plurality of transversal wall bodies 16 arranged along the width direction at the front-most and rear-most side locations of each hook and loop fastener member 20.

The base material 31 in the present embodiment 2 is formed in a thin board shape to be bendable in the upward and downward direction. Also, the base material 31 of each hook and loop fastener member 30 has a center region portion, on which a plurality of engaging elements 12 and the right and left support members 13 are erected, and right and left side edge portions 31*a* arranged outward in the width direction beyond locations where the right and left support members 13 are erected.

Also, upper surfaces (first surface) of the right and left side edge portions 31*a* of the base material 31 is formed as a flat surface, and right and left side edge ends of the base material 31 are formed to be parallel to each other along the longitudinal direction of the hook and loop fastener member 30. On a lower surface (back surface) of the base material 31, a plurality of recessed groove portions 31*b* are provided to be parallel to each other along the front and rear direction.

Further, the base material 31 has front and rear extension portions 31*c*, which are arranged on front and rear end edge portions of the hook and loop fastener member 30 and from which engaging elements 12 are excluded, and the front and rear extension portions 31*c* are formed to extend forward and rearward from locations, at which the engaging elements 12 and the transversal wall bodies 16 are arranged, throughout between the right and left support members 13.

Because the right and left side edge portions 31*a* and the front and rear extension portions 31*c* are arranged on the base material 31 of each hook and loop fastener member 30 as described above, the right and left side edge portions 31*a* and the front end rear extension portions 31*c* serve as canopies against a foaming resin material sprayed from a spraying nozzle upon foaming of a cushion body. Accordingly, it is possible to prevent the sprayed foaming resin material from being directly strongly hit between the resin material infiltration-blocking member 40 and the cavity surface 7*a*.

An engaging element region 38 of each hook and loop fastener member 30 is formed by a portion, in which a plurality of engaging elements 12 are aligned at a predetermined attachment pitch in the longitudinal direction and the width direction, and the right and left support members 13 are erected along the front and rear direction at locations, which are located on the inside of right and left end edges of the base material 31 in the width direction (right and left direction), so that the engaging element region 38 is sandwiched therebetween.

Like the case of the foregoing embodiment 1, each of right and left support members 13 in the present embodiment 2 has three longitudinal wall rows and each longitudinal wall row is constituted of a plurality of longitudinal wall bodies 13*a* arranged at a predetermined pitch in the longitudinal direction. Also, longitudinal wall connection portions for connecting longitudinal wall bodies 13*a* of the longitudinal wall rows, which are adjacent to each other in the width direction, are arranged in each support member 13.

Also, each hook and loop fastener member 30 of the present embodiment is configured so that the second fixation portions 35 for fixing the monofilament 45 is provided to protrude in a rectangular cross-sectioned block shape form the upper surface of the base material 31. The second fixation portions 35 are arranged on a generally center portion, in the width direction, of the base material 31 at a predetermined interval along the longitudinal direction. Also, the second fixation portions 35 are integrally constructed with the engaging elements 12 and the transversal wall bodies 16 erected from the base material 31, thereby reinforcing the engaging elements 12 and the transversal wall bodies 16. The monofilament 45 is embedded in the second fixation portion 35 to extend through the second fixation portions 35 in the longitudinal direction.

Alternatively, in the present invention, the second fixation portions 35 for fixing the monofilament 45 may be constructed as separate bodies from the transversal wall bodies 16. Also, the second fixation portions 35 may be arranged on a lower surface of the base material 31 so that the monofilament 35 is fixed to the lower surface of the base material 31.

In the molded hook and loop fastener 2 of the present embodiment 2, the monofilament 45 is fixed by the block-shaped second fixation portions 35 arranged on each hook and loop fastener member 30, and a connection portion for connecting the adjacent hook and loop fastener members 30 to each other is constructed by a part of the monofilament 35, which are interposed between a second fixation portion 35 arranged on the front-most side of each hook and loop fastener member 30 and a second fixation portion 35 arranged on the rear-most side of another hook and loop fastener member 30 adjacent thereto. In particular, the connection portion formed by the monofilament 45 is fixed to the second fixation portions 35, which are arranged on the generally center portions in the width direction, by a lower surface (back surface) of the resin material infiltration-blocking member 40, thereby connecting the center portions, in the width direction, of the adjacent hook and loop fastener members 30 to each other.

Also, the monofilament 45 in the present embodiment 2 is made of a thermoplastic resin, such as polyester and has flexibility. Also, the monofilament 45 is configured to be bent in a zigzag shape in the right and left direction, and particularly, a bending interval is set so that at least two bent portions having different bending directions are arranged in the part thereof between the second fixation portions 35, which forms the connection portion. In addition, a cross-section of the monofilament 45 has an elliptical shape, which is elongated in a front and back direction of the base material 31 so that the major axis thereof extends along the upward and downward direction.

Figure 12:
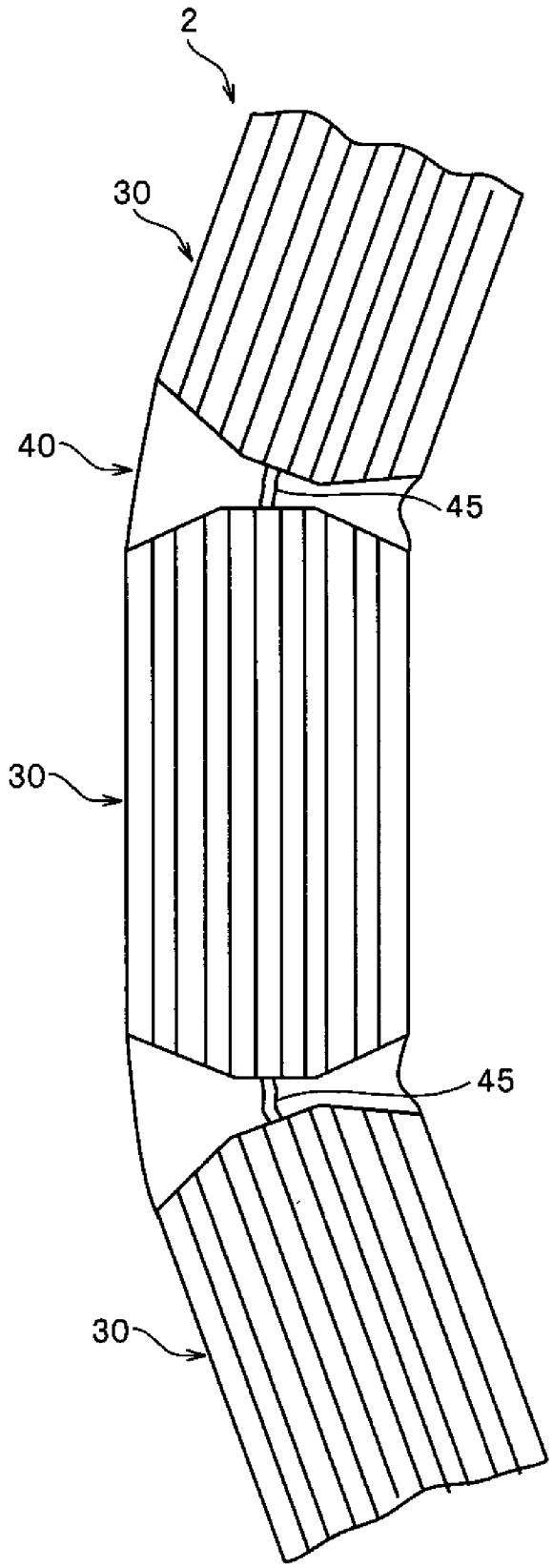
FIG. 12 is a bottom view of the molded hook and loop fastener when the molded hook and loop fastener is bent in a width direction thereof.

As the connection portion of the present embodiment 2 is configured as described above, the molded hook and loop fastener 2 having a plurality of hook and loop fastener members 30 can be configured to be easily bent in the width direction due to the connection portion and also to be bent in the front and back direction (see FIG. 12). Meanwhile, in the present invention, a thickness or cross-section shape of the monofilament 45 is not particularly limited, and thus it is sufficient so long as the molded hook and loop fastener 2 is designed to be bendable in the width direction due to the connection portion. Alternatively, in the present invention, the connection member does not need to be constructed by the monofilament 45 as in the present embodiment 2, and thus, for example, a plurality of hook and loop fastener members 30 may be connected to each other by a connection portion integrally molded with the hook and loop fastener members 30 using the same material (the same synthetic resin) as that of the base materials 31.

The resin material infiltration-blocking member 40 of the present embodiment 2 is constructed by a single sheet member made of a thin piece-shaped non-woven fabric having flexibility. Also, the resin material infiltration-blocking member 40 integrally has right and left longitudinal frame portions (first frame portions) 41 continuously arranged over the plurality of hook and loop fastener members 30 and transversal frame portions (second frame portions) 42 arranged in the width direction to bridge between the adjacent hook and loop fastener members 30 and configured to connect the right and left longitudinal frame portions 41 with each other, and a width dimension of the resin material infiltration-blocking member 40 itself is set to have a constant size over the entire length of the resin material infiltration-blocking member 40 in the longitudinal direction thereof. Further, in the resin material infiltration-blocking member 40, rectangular opening portions 43 surrounded by the longitudinal frame portions 41 and the transversal frame portions 42 are formed at a predetermined interval in the longitudinal direction.

In the resin material infiltration-blocking member 40 of the present embodiment 2 having such configurations, parts of the right and left longitudinal frame portions 41 are covered on the upper surfaces of the support members 13, parts of the transversal frame portions 42 are covered on upper surfaces of the transversal support portions 16*a* arranged on the front-most and rear-most sides of each hook and loop fastener member 30, and then the right and left longitudinal frame portions 41 are fixed to the right and left side edge portions 31*a* of the base material 31 of each hook and loop fastener member 30 by bonding or welding.

In this case, the width dimension of the resin material infiltration-blocking member 40 (dimension between outer side edges of the right and left longitudinal frame portions 41) is set to have a size of such a degree that the resin material infiltration-blocking member 40 does not protrude (extend out) from the right and left end edges of the base material 31 after being fixed to the hook and loop fastener members 30 and thus being partially bent.

Figure 11:
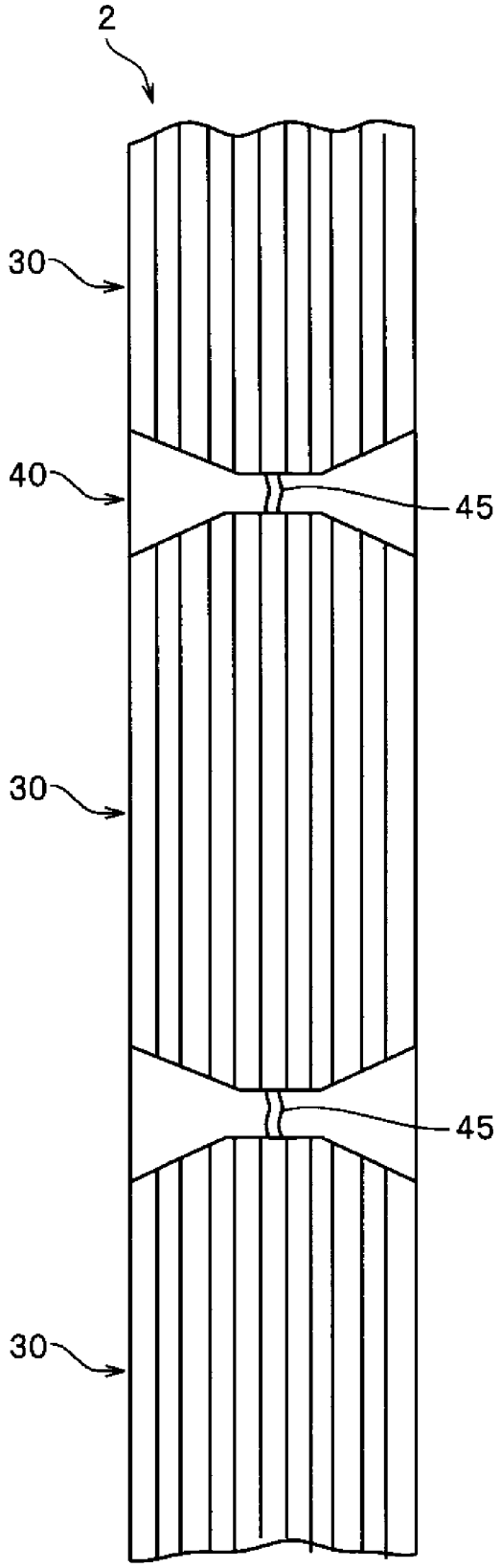
FIG. 11 is a bottom view of the molded hook and loop fastener.

In particular, in the present embodiment 2, the sheet-shaped resin material infiltration-blocking member 40 is configured so that when being fixed to the hook and loop fastener members 30, parts thereof between the plurality of hook and loop fastener members 30 have the same dimension as a width dimension of the resin material infiltration-blocking member 40 on the hook and loop fastener member 30 (see FIG. 11) and thus the entire width of the hook and loop fastener members 30 in the width direction is fully covered with each of parts thereof between the hook and loop fastener members 30. Thus, as described below, a bonding strength (fixation strength) between the molded hook and loop fastener 2 and a cushion body can be more effectively enhanced.

In addition, each of the rectangular opening portion 43 formed in the resin material infiltration-blocking member 40 has a length dimension smaller than a length dimension of the base material 31 of each hook and loop fastener member 30 and also has a width dimension smaller than a dimension as measured between outer surfaces of the right and left support members 13 of each hook and loop fastener member 30 in the width direction.

As the opening portions 43 of the resin material infiltration-blocking member 40 is set to have such a size, a positional offset of the opening portions 43 of the resin material infiltration-blocking member 40 relative to the engaging element region 18 of each hook and loop fastener member 30 can be hardly occurred. In addition, it is possible to prevent parts of engaging elements 12 or support members 13 from protruding above the resin material infiltration-blocking member 40 from the opening portion 43.

The molded hook and loop fastener 2 of the present embodiment 2 having configurations as described above can be easily bent to be curved or meandered in the right and left direction and the front and back direction as described above (see FIG. 12). When the molded hook and loop fastener 2 is bent in the right and left direction in such a way, the resin material infiltration-blocking member 40 is constructed of a pliable non-woven fabric and thus becomes in a state where in a region of the resin material infiltration-blocking member 40, which bridges between the adjacent hook and loop fastener member 30, a part thereof arranged on the outer circumferential side thereof is pulled and stretched (tensioned) by hook and loop fastener members 30 located front and rear thereof, and a part thereof arranged on the inner circumferential side is bent in a wave shape to create a clearance.

Also, like the foregoing embodiment 1, the molded hook and loop fastener 2 of the present embodiment is integrated with a cushion body (foam body) 6, such as seats of vehicles, while the cushion body is foamed, thereby obtaining the cushion body with the molded hook and loop fastener 2.

According to the cushion body with the molded hook and loop fastener 2 of the present embodiment 2 integrated, like the foregoing embodiment 1, it is possible to prevent the foam body from infiltrating into the engaging element region 38 of the molded hook and loop fastener 2. Therefore, a desired fastening force can be stably ensured by the plurality of engaging elements 12 exposed on the upper surface of the base material 11. Also, costs or workloads required to manufacture the mold 7 for molding the cushion body can be reduced as compared to the related art.

Also, because the molded hook and loop fastener 2 of the present embodiment 2 can be easily bent in the right and left direction as described above, the molded hook and loop fastener 2 can be closely contacted with the cavity surface 7*a* of the mold 7 in a curved or meandered state. Accordingly, the molded hook and loop fastener 2 of the present embodiment 2 can be easily conformed to various shapes of the cushion body.

In addition, when the molded hook and loop fastener 2 is integrated with the cushion in a curved or meandered state as described above, upon foaming, as described above, a part of the resin material infiltration-blocking member 49, which is arranged on the outer circumferential side thereof, is pulled and thus stretched (tensioned) and also a part thereof, which is arranged on the inner circumferential side, is bent to create a clearance, and in this state, the molded hook and loop fastener 2 is closely contacted with the cavity surface 7*a* of the mold 7. In this case, a gap is likely to be formed between the bent part of the resin material infiltration-blocking member 40, which is arranged on the inner circumferential side, and the cavity surface 7*a* of the mold 7, and thus the foaming resin material is likely to be introduced between the resin material infiltration-blocking member 40 and the cavity surface 7*a* through the gap.

In this state, when the foaming resin material is injected into the mold 7, the foaming resin material can be also allowed to be introduced and foamed on the back side of the resin material infiltration-blocking member 40 between the adjacent hook and loop fastener members 30. Thus, the cushion body having a predetermined shape can be stably manufactured.

Also, in the present embodiment 2, the tensioned part on the outer circumferential side and the bent part on the inner circumferential side of the resin material infiltration-blocking member 40, which are arranged between the hook and loop fastener members 30, as well as the connection member constructed of the monofilament 45 can be embedded in the molded cushion body. Accordingly, a bonding strength (fixation strength) between the molded hook and loop fastener 2 and the cushion body can be effectively increased.

In particular, as described above, the sheet-shaped resin material infiltration-blocking member 40 covers the hook and loop fastener members 30 over the entire width thereof in the width direction. Thus, the resin material infiltration-blocking member 40 is embedded over a broad area in the cushion body due to parts thereof between the adjacent hook and loop fastener members 30, thereby further enhancing the bonding strength (fixation strength) between the molded hook and loop fastener 2 and the cushion body.

Embodiment 3

Figure 13:
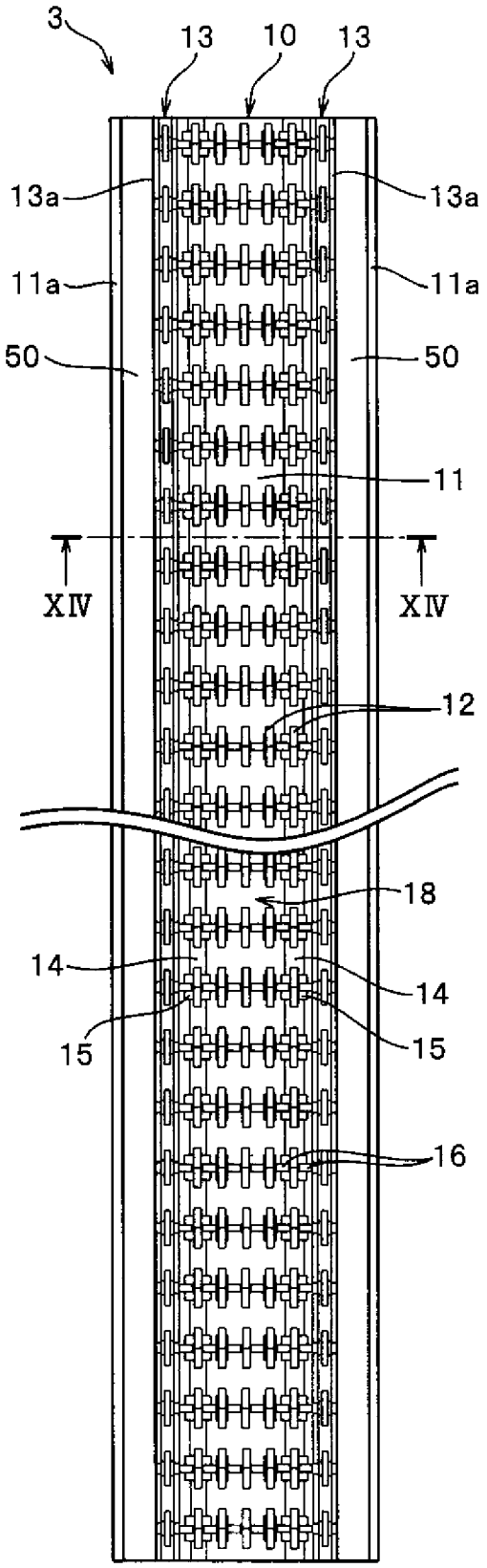
FIG. 13 is a plan view showing a molded hook and loop fastener according to an embodiment 3 of the present invention.
Figure 14:
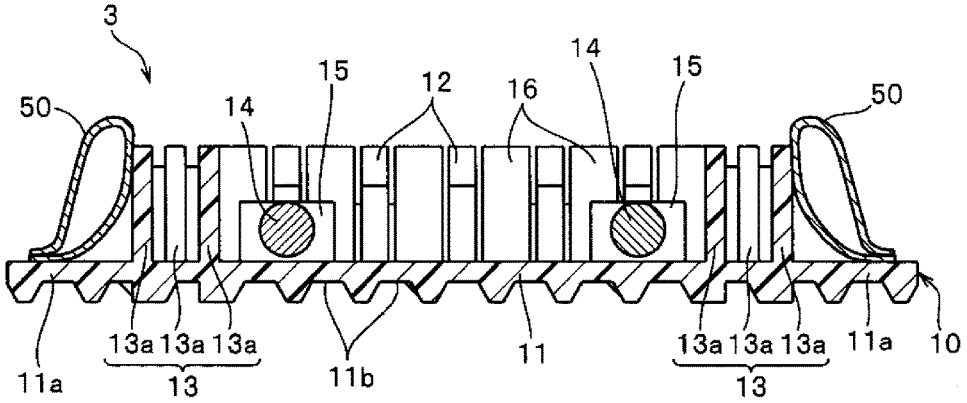
FIG. 14 is a sectional view taken along a XIV-XIV line shown in FIG. 13.

FIG. 13 is a plan view showing a molded hook and loop fastener according to the present embodiment 3, FIG. 14 is a sectional view taken along a XIV-XIV line shown in FIG. 13.

The molded hook and loop fastener 3 according to the present embodiment 3 includes one hook and loop fastener member 10 having a plurality of engaging elements 12 erected on an upper surface of a base material 11, and right and left independent resin material infiltration-blocking members 50. The hook and loop fastener member 10 of the present embodiment 3 has the same configurations as those of the hook and loop fastener member 10 of the forgoing embodiment 1.

The resin material infiltration-blocking members 50 of the present embodiment 3 are respectively independently fixed to right and left side edge portions 11*a* of the base material 11 of the hook and loop fastener member 10. The right and left resin infiltration-blocking members 50 are constructed of a sheet member made of a flexible thin piece-shaped non-woven fabric and have a tubular shape in which the thin piece-shaped sheet member is rolled by bonding side edge portions of the sheet member to each other.

In this case, the non-woven fabric constructing the resin material infiltration-blocking members 50 has suitable flexibility, pliability and swollen feeling. Also, the resin material infiltration-blocking members 50 formed in a tubular shape have the same length dimension as a length dimension of the base material 11 of the hook and loop fastener member 10.

Also, as shown in FIG. 14, the tubular-shaped resin material infiltration-blocking members 50 of the present embodiment 3 are fixed to the hook and loop fastener member 10 by bonding or welding bonded portions, at which the side edge portions thereof are bonded to each other, to right and left side edge portions 11*a* of the base material 11 in a state where the resin material infiltration-blocking members 50 are supported by right and left support members 13 while protruding upper ends thereof above upper end locations of the support members 13. In this case, preferably, the tubular-shaped resin material infiltration-blocking members 50 are also fixed to outer surfaces of the support members 13.

The molded hook and loop fastener 3 of the present embodiment 3 having the right and left tubular shaped resin material infiltration-blocking member 50 as described above are attracted and fixed to a cavity surface 7*a* of a cushion body molding mold 7 using a magnetic force of magnets 8 and then are integrated with a cushion body by foaming the cushion body, thereby obtaining the cushion body with the molded hook and loop fastener 3.

Figure 15:
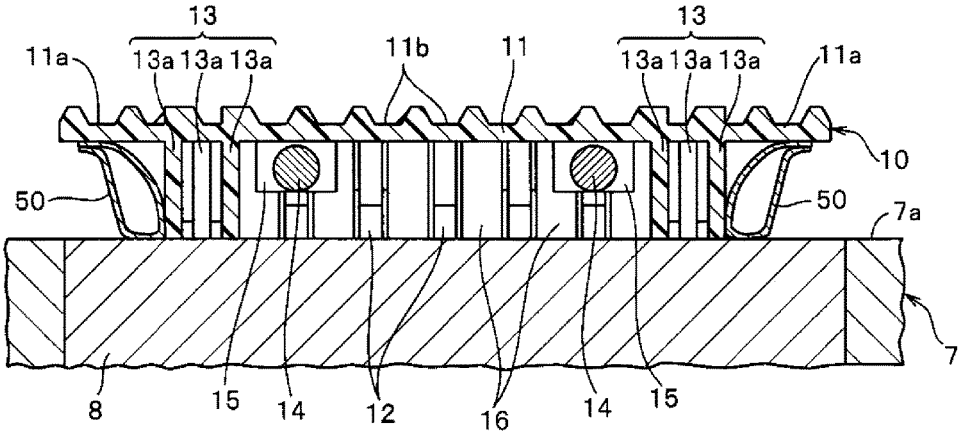
FIG. 15 is an enlarged sectional view showing a state where the molded hook and loop fastener is closely contacted with a cavity surface of a mold for molding a cushion body.

In this case, because the molded hook and loop fastener 3 of the present embodiment 3 is configured to protrude the upper ends of the resin material infiltration-blocking members 50 above the upper end locations of the support members 13, the right and left tubular-shaped resin material infiltration-blocking members 50, as shown in FIG. 15, are collapsed and closely contacted to the flat cavity surface 7*a* of the mold 7 when the molded hook and loop fastener 3 is attracted and fixed to the cavity surface 7*a* of the mold 7. Thus, it is possible to prevent a gap, which could allow a foaming resin material to pass therethrough, from being formed between the hook and loop fastener member 10 and the cavity surface 7*a*, between which the resin material infiltration-blocking members 50 are sandwiched.

Also, because the resin material infiltration-blocking members 50 are fixed to the base material 11 while being supported by the right and left support members 13, it is possible to prevent a positional offset of the resin material infiltration-blocking members 50 and also to prevent a gap from being formed between the resin material infiltration-blocking members 50 and the cavity surface 7*a*, even if a flowing pressure or foaming pressure of the foaming resin material is exerted thereon. Thus, in the present embodiment 3, it is possible to stably prevent the foaming resin material from infiltrating into the engaging element region 18 over the resin material infiltration-blocking members 50 from the right and left direction.

Meanwhile, in the molded hook and loop fastener 3 of the present embodiment 3, the resin material infiltration-blocking members 50 are not arranged on front and rear ends of the hook and loop fastener member 10, but engaging elements 12 and transversal wall bodies 16, which are arranged along the width direction at the front-most location of the hook and loop fastener member 10, and engaging elements 12 and transversal wall bodies 16, which are arranged along the width direction at the rear-most location thereof, sever as transversal blocking wall portions for blocking infiltration of the foaming resin material into the engaging element region 18. Accordingly, it is also possible to prevent the foaming resin material from infiltrating in the front and rear direction.

Specifically, when the molded hook and loop fastener 3 of the present embodiment 3 is attracted and fixed to the flat cavity surface 7*a* of the mold 7, as shown in FIG. 15, upper end surfaces of the engaging elements 12 and upper end surfaces of the transversal wall bodies 16 of the hook and loop fastener member 10 can be closely contacted with the cavity surface 7*a* of the mold 7. In this way, by closely contacting the engaging elements 12 and the transversal wall bodies 16 of the hook and loop fastener member 10, the transversal blocking wall portions are constructed by the engaging elements 12 and the transversal wall bodies 16, which are aligned to each other in the width direction, so that infiltration of the foaming resin material into the engaging element region 18 can be blocked by the transversal blocking wall portions.

Meanwhile, in the transversal blocking wall portions constructed by the engaging elements 12 and the transversal wall bodies 16, small gaps are formed between the engaging elements 12 and the transversal wall bodies 16. However, because all of the gaps are very small, even if the foaming resin material is introduced through the gaps, the foaming resin material is cooled and solidified before infiltrating into the engaging element region 18 or immediately after infiltrating into the engaging element region 18. Accordingly, the foaming resin material cannot reach deeply into the engaging element region 18 through the gaps of the transversal blocking wall portions 14.

Therefore, in the cushion body, with which the molded hook and loop fastener 3 of the present embodiment 3 is integrated, the foaming resin material does not infiltrate into the engaging element region 18 of the molded hook and loop fastener 3 so that the engaging elements 12 can be stably exposed on the upper surface of the base material 11. Accordingly, a predetermined engaging force (fastening force) inherent in the molded hook and loop fastener 3 can be stably ensured. Also, costs or workloads required to manufacture the mold 7 for molding the cushion body can be reduced as compared to the related art.

Embodiment 4

Figure 16:
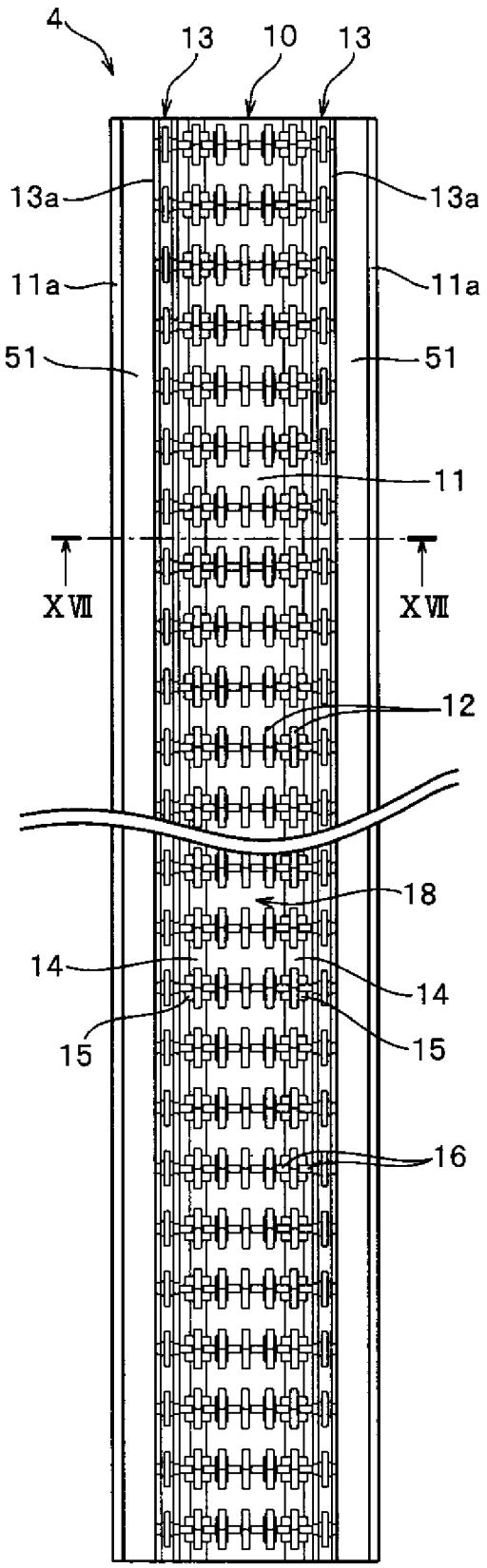
FIG. 16 is a plan view showing a molded hook and loop fastener according to an embodiment 4 of the present invention.
Figure 17:
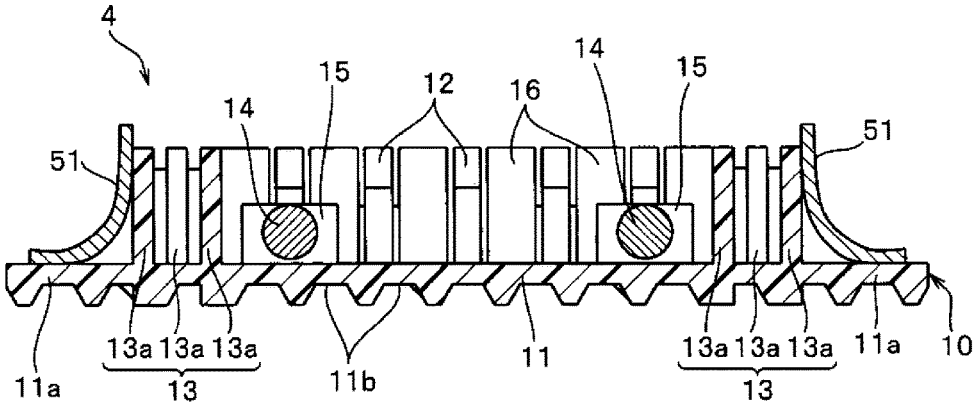
FIG. 17 is a sectional view taken along a XVII-XVII line shown in FIG. 16.

FIG. 16 is a plan view showing a molded hook and loop fastener according to the present embodiment 4, and FIG. 17 is a sectional view taken along a XVII-XVII line shown in FIG. 16.

The molded hook and loop fastener 4 according to the present embodiment 4 includes one hook and loop fastener member 10 having a plurality of engaging elements 12 erected on an upper surface of a base material 11, and right and left independent resin material infiltration-blocking members 51. The hook and loop fastener member 10 of the present embodiment 4 has the same configurations as those of the hook and loop fastener member 10 of the forgoing embodiment 1.

The resin material infiltration-blocking members 51 of the present embodiment 4 are respectively independently fixed to right and left side edge portions 11*a* of the base material 11 of the hook and loop fastener member 10. The right and left resin infiltration-blocking members 51 are constructed of a sheet member made of a flexible thin piece-shaped non-woven.

In this case, the non-woven fabric constructing the resin material infiltration-blocking members 51 has suitable flexibility, pliability and swollen feeling. Also, the resin material infiltration-blocking members 51 have the same length dimension as a length dimension of the base material 11 of the hook and loop fastener member 10.

In addition, as shown in FIG. 17, the resin material infiltration-blocking members 51 of the present embodiment 4 are boned or welded to the right and left side edge portions 11*a* of the base material 11 and outer surfaces of right and left support members 13 in a state where the resin material infiltration-blocking members 51 are supported by the support members 13 while protruding upper ends thereof above upper end locations of the support members 13. By doing so, the resin material infiltration-blocking members 51 are fixed to the hook and loop fastener member 10 to have a generally L-shape.

The molded hook and loop fastener 4 of the present embodiment 4 having the right and left resin material infiltration-blocking member 51 as described above are attracted and fixed to a cavity surface 7*a* of a cushion body molding mold 7 using a magnetic force of magnets 8 and then are integrated with a cushion body by foaming the cushion body, thereby obtaining the cushion body with the molded hook and loop fastener 4.

In this case, because the molded hook and loop fastener 4 of the present embodiment 4 is configured to protrude the upper ends of the resin material infiltration-blocking members 51 above the upper end locations of the support members 13, the upper ends of the resin material infiltration-blocking members 51 are bent outward and closely contacted to the flat cavity surface 7*a* of the mold 7 when the molded hook and loop fastener 4 is attracted and fixed to the cavity surface 7*a* of the mold 7. Thus, it is possible to prevent a gap, which could allow a foaming resin material to pass therethrough, from being formed between the hook and loop fastener member 10 and the cavity surface 7*a*, between which the resin material infiltration-blocking members 51 are sandwiched.

Also, because the resin material infiltration-blocking members 51 are fixed to the base material 11 while being supported by the support members 13, it is possible to prevent a positional offset of the resin material infiltration-blocking members 51 and also to prevent a gap from being formed between the resin material infiltration-blocking members 51 and the cavity surface 7*a*, even if a flowing pressure or foaming pressure of the foaming resin material is exerted thereon. Thus, in the present embodiment 4, it is possible to stably prevent the foaming resin material from infiltrating into the engaging element region 18 over the resin material infiltration-blocking members 51 from the right and left direction.

Meanwhile, in the molded hook and loop fastener 4 of the present embodiment 4, the resin material infiltration-blocking members 51 are not arranged on front and rear ends of the hook and loop fastener member 10, but like the foregoing embodiment 3, engaging elements 12 and transversal wall bodies 16, which are arranged along the width direction at the front-most location of the hook and loop fastener member 10, and engaging elements 12 and transversal wall bodies 16, which are arranged along the width direction at the rear-most location thereof, sever as transversal blocking wall portions for blocking infiltration of the foaming resin material into the engaging element region 18. Accordingly, it is also possible to prevent the foaming resin material from infiltrating in the front and rear direction.

Accordingly, in the cushion body, with which the molded hook and loop fastener 4 of the present embodiment 4 is integrated, the foaming resin material does not infiltrate into the engaging element region 18 of the molded hook and loop fastener 4 so that the engaging elements 12 can be stably exposed on the upper surface of the base material 11. Accordingly, a predetermined engaging force (fastening force) inherent in the molded hook and loop fastener 4 can be stably ensured. Also, costs or workloads required to manufacture the mold 7 for molding the cushion body can be reduced as compared to the related art.

Embodiment 5

Figure 18:
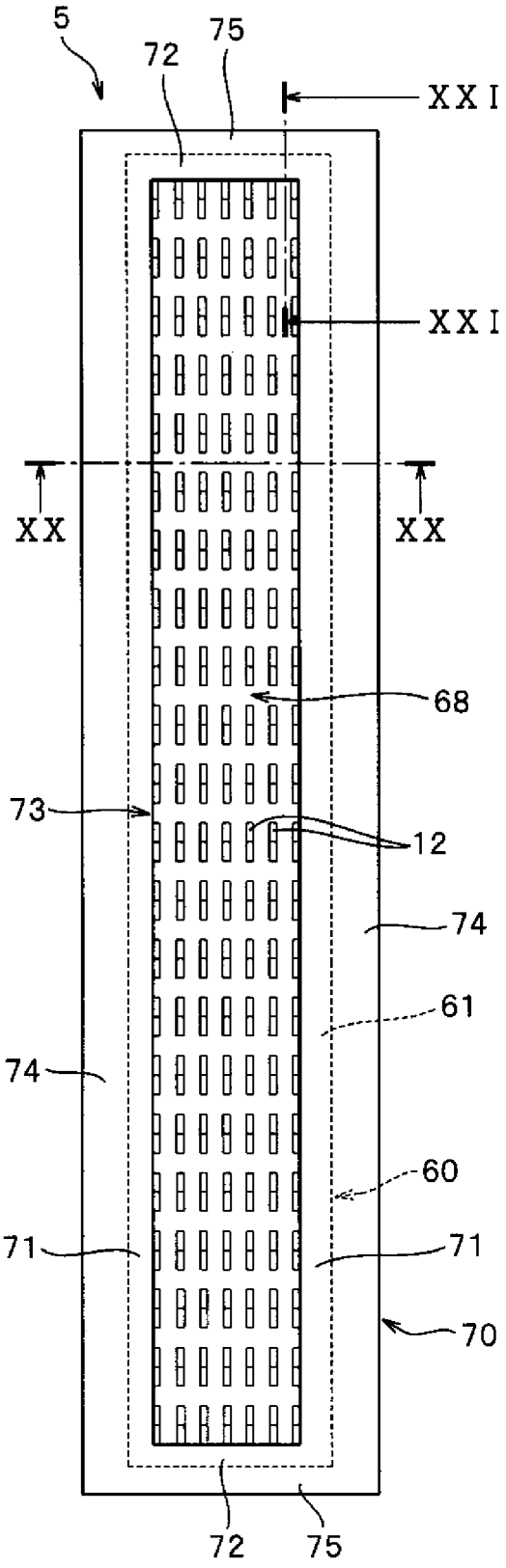
FIG. 18 is a plan view showing a molded hook and loop fastener according to an embodiment 5 of the present invention.
Figure 19:
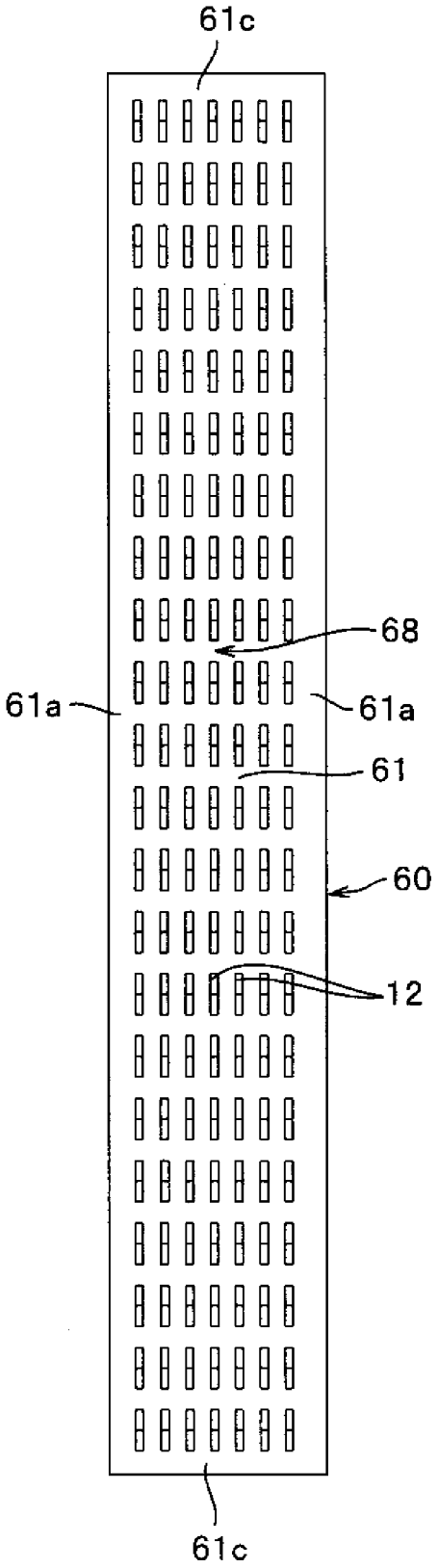
FIG. 19 is a plan view showing a hook and loop fastener member of the molded hook and loop fastener.
Figure 20:
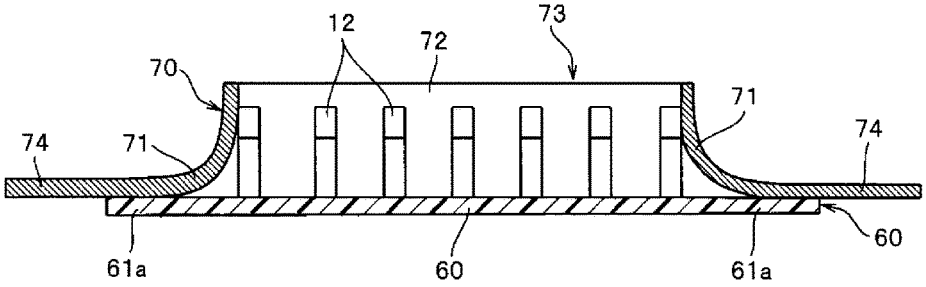
FIG. 20 is a sectional view taken along a XX-XX line shown in FIG. 18.
Figure 21:
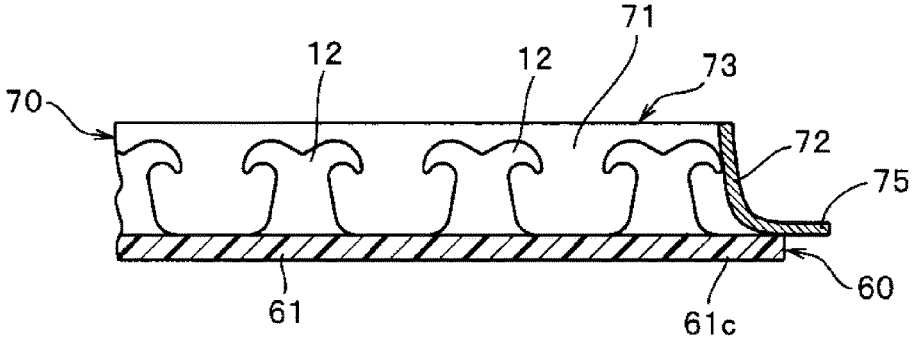
FIG. 21 is a sectional view taken along a XX-XX line shown in FIG. 18.
Figure 22:
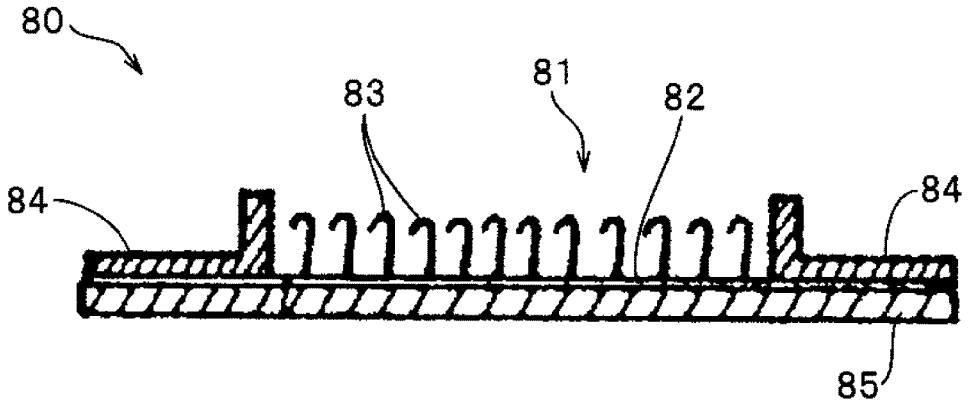
FIG. 22 is a sectional view showing a conventional hook and loop fastener.
Figure 23:
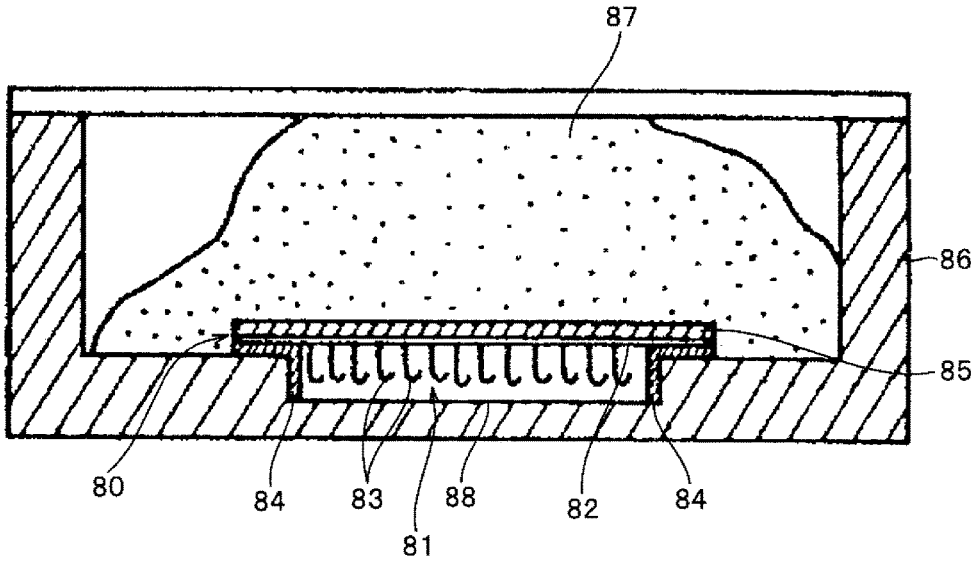
FIG. 23 is a schematic view showing a state where the conventional hook and loop fastener is set on a cavity surface of a mold for molding a cushion body and then a foam resin material is injected into the mold.

FIG. 18 is a plan view showing a molded hook and loop fastener according to the present embodiment 5, and FIG. 19 is a plan view showing a hook and loop fastener member of the molded hook and loop fastener. Also, FIGS. 20 and 21 are sectional views taken along a XX-XX line and a XX-XX line shown in FIG. 18.

The molded hook and loop fastener 5 according to the present embodiment 5 includes one hook and loop fastener member 60 having a plurality of engaging elements 12 erected on an upper surface of a base material 61 and a resin material infiltration-blocking member 70 fixed to the hook and loop fastener member 60 and having a frame shape.

The hook and loop fastener member 60 according to the present embodiment 5 includes a flat plate-shaped base material 61 and a plurality of engaging elements (male engaging elements) 12 erected on the upper surface of the base material 61, but the right and left support members 13, transversal wall bodies 16, linear magnetic bodies 14 and fixation portions 15 arranged on the hook and loop fastener member 10 of the foregoing embodiment 1 are excluded from the hook and loop fastener member 60 of the present embodiment 5. Also, in the present embodiment 5, the hook and loop fastener member 60 is configured to have a magnetic property by mixing or kneading magnetic particles to a synthetic resin constructing the hook and loop fastener member 60.

The base material 61 of the hook and loop fastener member 60 has a rectangular thin plate shape elongated in the front and rear direction (longitudinal direction) as viewed in the upward and downward direction.

The engaging elements 12 according to the present embodiment 5 are erected on the upper surface of the base material 61 to be aligned at a predetermined attachment pitch in the longitudinal direction and the width direction and thus form an engaging element region 68 of the hook and loop fastener member 60 of the present embodiment 5. In particular, in the case of the present embodiment 5, longitudinal rows of engaging elements 12 aligned along the longitudinal direction are arranged to be arrayed in seven rows in the width direction. Also, each engaging element 12 of the present embodiment 5 has an erection portion perpendicularly erected from the upper surface of the base material 61 and a hook-shaped engaging head portion branched and curved in the front and rear direction at an upper end of the erection portion, and thus the shape itself of the engaging elements 12 are the same as that of the engaging elements 12 of the foregoing embodiment 1.

The hook and loop fastener member 60 according to the present embodiment 5 is not provided with the right and left support members 13 arranged on the hook and loop fastener member 10 of the foregoing embodiment 1, but engaging elements 12, which are arranged in the outermost longitudinal rows in the width direction, (i.e., engaging elements 12 arranged in the leftmost longitudinal row and engaging elements 12 arranged in the rightmost longitudinal row) are configured as engaging elements 12 for forming the engaging element region 68 and also are configured to serve as support members for supporting longitudinal frame portions 71, as described below, of the resin material infiltration-blocking member 70.

Also, engaging elements 12, which are arranged in the front-most transversal row in the longitudinal direction, and engaging elements 12, which are arranged in the rear-most transversal row, are configured as engaging elements 12 for forming the engaging element region 68 and also are configured to serve as support members 13 for supporting transversal frame portions 72, as described below, of the resin material infiltration-blocking member 70.

The resin material infiltration-blocking member 70 according to the present embodiment 5 is constructed of a sheet member made of a flexible thin piece-shaped non-woven fabric. The resin material infiltration-blocking member 70 has a frame shape. Namely, the resin material infiltration-blocking member 70 has right and left longitudinal frame portions (first frame portions) 71 arranged along the longitudinal direction of the molded hook and loop fastener 5 and transversal frame portions (second frame portions) 72 arranged along the width direction to correspond to locations of front and rear end portions of the hook and loop fastener member 60 and configured to connect the right and left longitudinal frame portions 71 with each other. Also, a rectangular opening portion 73 is formed in a center portion of the resin material infiltration-blocking member 70 to be surrounded by the right and left longitudinal frame portions 71 and the front and rear transversal frame portions 72.

The right and left longitudinal frame portions 71 of the resin material infiltration-blocking member 70 are bonded or welded to the right and left side edge portions 61*a* of the base material 61 of the hook and loop fastener member 60 while protruding inner peripheral edge portions (inner peripheral edge portions at the side of the opening portion 73) of the longitudinal frame portions 71 above upper end locations of the engaging elements 12. Also, the front and rear transversal frame portions 72 are bonded or welded to front and rear end edge portions 61*c* of the base material 61 of the hook and loop fastener member 60 while protruding inner peripheral edge portions (side edge portion 61*a* of the opening portion 73) of the transversal frame portions 72 above upper end locations of the engaging elements 12.

At this time, the right and left longitudinal frame portions 71 and front and rear transversal frame portions 72 of the resin material infiltration-blocking member 70 are respectively supported by a plurality of engaging elements (support member) 12 of the hook and loop fastener member 60, which are arranged in the rightmost and leftmost longitudinal rows in the width direction, and a plurality of engaging elements (support member) 12, which are arranged in the front-most and rear-most transversal rows in the longitudinal direction.

Thus, the longitudinal frame portions 71 and transversal frame portions 72 of the resin material infiltration-blocking member 70 are hardly collapsed or bend even if a flowing pressure or foaming pressure of a foaming resin material is exerted thereon when a cushion body is foamed, and also the state where the inner peripheral edge portions of the longitudinal frame portions 71 and transversal frame portions 72 are protruded above the upper end locations of the engaging elements 12 can be stably kept.

In the present embodiment 5, a length dimension of the resin material infiltration-blocking member 70 (i.e., a length dimension of the longitudinal frame portions 71) is set to be larger than a length dimension of the base material 61 of the hook and loop fastener member 60 when the resin material infiltration-blocking member 70 is in a flat state before being attached to the hook and loop fastener member 60, and also even when the resin material infiltration-blocking member 70 is in a state after being fixed to the hook and loop fastener member 10 and thus being partially bent, the resin material infiltration-blocking member 20 is set to have a length dimension larger than that of the base material 61 of the hook and loop fastener member 60.

A width dimension of the resin material infiltration-blocking member 70 (i.e., a dimension between outer side edges of the right and left longitudinal frame portions 71 in the width direction) is set to be larger than a width dimension of the base material 61 of the hook and loop fastener member 60 when the resin material infiltration-blocking member 70 is in a flat state before being attached to the hook and loop fastener member 60, and also even when the resin material infiltration-blocking member 70 is in a state after being fixed to the hook and loop fastener member 60 and thus being partially bent, the resin material infiltration-blocking member 70 is set to have a width dimension larger than that of the base material 61 of the hook and loop fastener member 60.

Namely, when being fixed to the hook and loop fastener member 60, the resin material infiltration-blocking member 70 of the present embodiment 5 has right and left first extension portions 74 extending outward beyond right and left end edges of the base material 61 of the hook and loop fastener member 60 and front and rear second extension portions 75 extending outward beyond front and rear end edges of the base material 61 of the hook and loop fastener member 60.

In addition, the rectangular opening portion 73 formed in the center portion of the resin material infiltration-blocking member 70 has length and width dimensions smaller than length and width dimensions of the base material 61 of the hook and loop fastener member 60. Accordingly, a positional offset of the opening portion 73 of the resin material infiltration-blocking member 70 relative to the engaging element region 68 of the hook and loop fastener member 60 can be hardly occurred.

The molded hook and loop fastener 5 of the present embodiment 5 having configurations as described above are attracted and fixed to a cavity surface 7*a* of a cushion body molding mold 7 using a magnetic force of magnets 8 and then are integrated with a cushion body by foaming the cushion body, thereby obtaining the cushion body with the molded hook and loop fastener 5.

In this case, because the molded hook and loop fastener 5 of the present embodiment 5 is configured so that the inner peripheral edge portions of the right and left longitudinal frame portions 71 and front and rear transversal frame portions 72 of the resin material infiltration-blocking member 70 are protruded above the upper end locations of the engaging elements 12, the inner peripheral edge portions of the resin material infiltration-blocking member 70 can be closely contacted with the flat cavity surface 7*a* of the mold 7 when the molded hook and loop fastener 5 is attracted and fixed to the cavity surface 7*a* of the mold 7. Thus, it is possible to prevent a gap, which could allow the foaming resin material to pass therethrough, from being formed between the hook and loop fastener member 60 and the cavity surface 7*a*, between which the resin material infiltration-blocking member 70 is sandwiched.

Also, because the resin material infiltration-blocking member 70 is fixed to the right and left side edge portions 61*a* and front and rear end edge portions 61*c* of the baste material 61 while being supported by the engaging elements 12 as described above, it is possible to prevent a positional offset of the resin material infiltration-blocking member 70 and also to prevent a gap from being formed between the resin material infiltration-blocking member 70 and the cavity surface 7*a*, even if a flowing pressure or foaming pressure of the foaming resin material is exerted thereon. Thus, in the present embodiment 4, it is possible to stably prevent the foaming resin material from infiltrating into the engaging element region 68 over the resin material infiltration-blocking member 70 from the right and left direction and the front and rear direction.

Therefore, in the cushion body, with which the molded hook and loop fastener 5 of the present embodiment 5 is integrated, the foaming resin material does not infiltrate into the engaging element region 68 of the molded hook and loop fastener 5 so that the engaging elements 12 can be stably exposed on the upper surface of the base material 61. Accordingly, a predetermined engaging force (fastening force) inherent in the molded hook and loop fastener 5 can be stably ensured. Also, costs or workloads required to manufacture the mold 7 for molding the cushion body can be reduced as compared to the related art.

Further, in the cushion body with which the molded hook and loop fastener 5 of the present embodiment 5 is integrated, the first and second extension portions 74 and 75 of the resin material infiltration-blocking member 70 extending from the base material 61 are embedded in the cushion body. Accordingly, a bonding strength (fixation strength) between the molded hook and loop fastener 5 and the cushion body can be effectively increased, so that the molded hook and loop fastener 5 can be more strongly integrated with the cushion body.

DESCRIPTION OF REFERENCE NUMERALS

1, 2, 3 Molded Hook and Loop Fastener
4, 5 Molded Hook and Loop Fastener
6 Cushion Body (Foam Body)
7 Mold
7*a* Cavity Surface
8 Magnet
10 Hook and Loop Fastener Member
11 Base Material
11*a* Side Edge Portion
11*b* Recessed Groove Portion
12 Engaging Element
13 Support Member
13 Longitudinal Wall Body
14 Linear Magnetic Body
15 Fixation Portion (First Fixation Portion)
16 Transversal Wall Body
16*a* Transversal Support Portion
18 Engaging Element Region
20 Resin Material Infiltration-Blocking Member
21 Longitudinal Frame Portion (First Frame Portion)
22 Transversal Frame Portion (Second Frame Portion)
23 Opening Portion
24 First Extension Portion
25 Second Extension Portion
30 Hook and Loop Fastener Member

31 Base Material
31*a* Side Edge Portion
31*b* Recessed Groove Portion
31*c* Extension Portion
35 Fixation Portion (Second Fixation Portion)
38 Engaging Element Region
40 Resin Material Infiltration-Blocking Member
41 Longitudinal Frame Portion (First Frame Portion)
42 Transversal Frame Portion (Second Frame Portion)
43 Opening Portion
45 Monofilament
50 Resin Material Infiltration-Blocking Member
51 Resin Material Infiltration-Blocking Member
60 Hook and Loop Fastener Member
61 Base Material
61*a* Side Edge Portion
61*c* End Edge Portion
68 Engaging Element Region
70 Resin Material Infiltration-Blocking Member
71 Longitudinal Frame Portion (First Frame Portion)
72 Transversal Frame Portion (Second Frame Portion)
73 Opening Portion
74 First Extension Portion
75 Second Extension Portion

The invention claimed is:

1. A molded hook and loop fastener having at least one hook and loop fastener member which comprises a flat plate-shaped base material and a plurality of engaging elements erected on a first surface of the base material in a center region in a width direction thereof, and configured to be integrated with a cushion body upon foaming of the cushion body, the molded hook and loop fastener comprising:

a flexible sheet-shaped resin material infiltration-blocking member fixed to right and left side edge portions, in the width direction, of the first surface of the base material and arranged along a longitudinal direction of the base material; and right and left support members erected along the longitudinal direction of the base material at locations which are located on the inside of fixation portions of the resin material infiltration-blocking member with respect to the base material in the width direction, and configured to support the resin material infiltration-blocking member, wherein an upper end of the resin material infiltration-blocking member is configured to protrude above an upper end location of the support members.

2. The molded hook and loop fastener according to claim 1, wherein the molded hook and loop fastener is constituted of one hook and loop fastener member, and wherein the resin material infiltration-blocking member comprises right and left first frame portions continuously arranged over the entire length of the base material in the longitudinal direction and second frame portions arranged along the width direction of the hook and loop fastener member on both ends of the hook and loop fastener member in the longitudinal direction and configured to connect the right and left frame portions with each other.

3. The molded hook and loop fastener according to claim 2, wherein the first frame portions and the second frame portions are integrally formed with each other, and the resin material infiltration-blocking member is constructed of a single member.

4. The molded hook and loop fastener according to claim 2, wherein the resin material infiltration-blocking member comprises a rectangular opening portion surrounded by the first frame portions and the second frame portions, and wherein a dimension of the opening portion in the width direction is set to be smaller than a dimension between outer surfaces of the right and left support members and also a dimension of the opening portion in the longitudinal direction is set to be smaller than a dimension of the hook and loop fastener member in the longitudinal direction.

5. The molded hook and loop fastener according to claim 1, wherein the sheet-shaped resin material infiltration-blocking member has a tubular shape obtained by connecting side edge portions of the resin material infiltration-blocking member to each other and is fixed to the right and left side edge portions of the base material.

6. The molded hook and loop fastener according to claim 1, wherein the molded hook and loop fastener comprises a plurality of hook and loop fastener members and a flexible connection member for connecting the plurality of hook and loop fastener members along the longitudinal direction, and wherein the resin material infiltration-blocking member comprises right and left first frame portions continuously arranged in the longitudinal direction over the plurality of hook and loop fastener members and second frame portions arranged in the width direction of the hook and loop fastener members to bridge between the adjacent hook and loop fastener members and configured to connect the right and left first frame portions with each other.

7. The molded hook and loop fastener according to claim 6, wherein the first frame portions and the second frame portions are integrally formed with each other, and the resin material infiltration-blocking member is constructed of a single member.

8. The molded hook and loop fastener according to claim 6, wherein the sheet-shaped resin material infiltration-blocking member has a constant width dimension over the entire length thereof in the longitudinal direction and is configured to cover the plurality of hook and loop fastener members over the entire width of the hook and loop fastener members in the width direction.

9. The molded hook and loop fastener according to claim 6, wherein the connection member is configured to connect center portions, in the width direction, of the plurality of hook and loop fastener members to each other on a lower surface of the resin material infiltration-blocking member.

10. The molded hook and loop fastener according to claim 1, wherein the resin material infiltration-blocking member is configured to extend outward in the width direction beyond right and left end edges of the base material.

11. The molded hook and loop fastener according to claim 1, wherein the resin material infiltration-blocking member is constructed of a non-woven fabric.

12. The molded hook and loop fastener according to claim 1, wherein the right and left support members are constituted of wall members integrally formed with the base material and intermittently or continuously erected thereon along a front and rear direction so that an engaging element region constituted of a plurality of engaging elements is interposed therebetween.

13. A method of manufacturing a cushion body, wherein the molded hook and loop fastener according to claim 1 is closely contacted with a fastener mount surface of a mold so that the first surface of the base material faces the fastener mount surface, and then foaming is performed so that the molded hook and loop fastener is integrated with the cushion body.

14. The method of manufacturing the cushion body according to claim 13, wherein the fastener mount surface of the mold is formed as a single surface, wherein the method comprises closely contacting the molded hook and loop fastener with the single surface.

* * * * *